United States Patent [19]

Erickson, Jr.

[11] Patent Number: 4,883,245

[45] Date of Patent: Nov. 28, 1989

[54] TRANSPORATION SYSTEM AND METHOD OF OPERATION

[76] Inventor: Thomas F. Erickson, Jr., 213 Engle Dr., Wallingford, Pa. 19086

[21] Appl. No.: 74,534

[22] Filed: Jul. 16, 1987

[51] Int. Cl.[4] ..... B61L 27/00

[52] U.S. Cl. ..... 246/2 R; 104/307; 246/1 R; 246/2 F

[58] Field of Search ..... 104/18, 307; 246/1 R, 246/2 R, 2 F

[56] References Cited

U.S. PATENT DOCUMENTS

| | | | |
|---|---|---|---|
| 3,219,815 | 11/1965 | Livingston | 246/3 |
| 3,250,914 | 5/1966 | Reich | 246/5 |
| 3,895,584 | 7/1975 | Paddison | 104/88 |
| 3,933,099 | 1/1976 | Sieb et al. | 104/88 |
| 4,023,753 | 5/1977 | Dobler | 246/5 |
| 4,066,228 | 1/1978 | Elder | 246/5 |
| 4,361,300 | 11/1982 | Rush | 246/5 |
| 4,361,301 | 11/1982 | Rush | 246/34 R |

*Primary Examiner*—Ronald C. Capossela
*Attorney, Agent, or Firm*—Volpe and Koenig

[57] ABSTRACT

A transportation system and method of operation are disclosed wherein a network of nodes, such as railway stations, are defined between which relays, such as freight trains, are operated at a selected cue frequency to thereby provide regular and predetermined service to each node within the system. The system also includes a procedure for interchanging blocks, such as freight cars, which comprise the relays upon arrival at and for departure at the respective nodes. Scheduling of operating crews for return to their respective node of origin during a normal shift period is also disclosed.

22 Claims, 27 Drawing Sheets find $x_{ij}$'s and $y_{ikj}$'s so as to minimize $Z = \sum_{i=1}^{n} \sum_{j=1}^{n} c_{ij} x_{ij}$, for $i \neq j$ subject to $a_{ij} x_{ij} + \sum_{k=1}^{p} y_{ikj} - \sum_{h=1}^{q} y_{hij} \geq b_{ij}$, for $i \neq j$ and $x_{ij} = 0, 1, 2 \ldots m$ $y_{ikj} = 0, 1, 2 \ldots m$ $y_{hij} = 0, 1, 2 \ldots m$ where a "primary route" is one with no intermediate stops a "secondary route" is a combination of primary routes $n$ = number of yards $x_{ij}$ = no. of trains run on primary route from yard $i$ to yard $j$ $c_{ij}$ = variable cost of primary route train from yard $i$ to yard $j$ $a_{ij}$ = max. no. of cars on primary route train from yard $i$ to yard $j$ $b_{ij}$ = no. of cars to be moved from yard $i$ to yard $j$ $y_{ikj}$ = no. of cars moved from yard $i$ to yard $j$ via one of the secondary routes $ikj$, $p$ in no., but not via a primary route train from yard $i$ to yard $j$ $y_{hij}$ = the no. of cars moved from yard $i$ to yard $j$ via one of the secondary routes $hij$, $q$ in no., which begins with, or ends with or is embedded with a primary route train from yard $i$ to yard $j$ $p = (n-2)u$, where $u$ = the no. of routes for $(n-1)$ yards $q = p(n-1) + (n-2)(1-u)$

Figure 1 find $x_{ij}$'s and $y_{ikj}$'s so as to minimize $Z = \sum_{i=1}^{n} \sum_{j=1}^{n} c_{ij} x_{ij}$, for $i \neq j$ subject to $a_{ij} x_{ij} + \sum_{k=1}^{p} y_{ikj} - \sum_{h=1}^{q} y_{hij} \geq b_{ij}$, for $i \neq j$ and $x_{ij} = 0, 1, 2 \ldots m$ $y_{ikj} = 0, 1, 2 \ldots m$ $y_{hij} = 0, 1, 2 \ldots m$ where a "primary route" is one with no intermediate stops a "secondary route" is a combination of primary routes $n$ = number of yards $x_{ij}$ = no. of trains run on primary route from yard $i$ to yard $j$ $c_{ij}$ = variable cost of primary route train from yard $i$ to yard $j$ $a_{ij}$ = max. no. of cars on primary route train from yard $i$ to yard $j$ $b_{ij}$ = no. of cars to be moved from yard $i$ to yard $j$ $y_{ikj}$ = no. of cars moved from yard $i$ to yard $j$ via one of the secondary routes $ikj$, $p$ in no., but not via a primary route train from yard $i$ to yard $j$ $y_{hij}$ = the no. of cars moved from yard $i$ to yard $j$ via one of the secondary routes $hij$, $q$ in no., which begins with, or ends with or is embedded with a primary route train from yard $i$ to yard $j$ $p = (n-2)u$, where $u$ = the no. of routes for $(n-1)$ yards $q = p(n-1) + (n-2)(1-u)$

Figure 2

| A<br>number of yards<br>(n) | B<br>no. of primary routes<br>$(n^2-n)$ | C*<br>primary & secondary routes betw. each pair<br>$(n-2)u+1$ | D<br>no. secondary routes, q, using ea. primary route<br>$C_{n+1}-C_n-1$ | E<br>no. secondary routes, p, per primary route<br>$C_n-1$ | F<br>no. of secondary routes<br>B×E | G<br>tot. variables, primary and secondary routes<br>B+F |
|---|---|---|---|---|---|---|
| 2 | 2 | 1 | 0 | 0 | 0 | 2 |
| 3 | 6 | 2 | 2 | 1 | 6 | 12 |
| 4 | 12 | 5 | 10 | 4 | 48 | 60 |
| 5 | 20 | 16 | 48 | 15 | 300 | 320 |
| 6 | 30 | 65 | 260 | 64 | 1,920 | 1,950 |
| 7 | 42 | 326 | 1,630 | 325 | 13,650 | 13,692 |
| 8 | 56 | 1,957 | 11,742 | 1,956 | 109,536 | 109,592 |

* where u = no. of routes for n-1 yards

Legend:

- • Node
- = Double-wide transportation Line
- 1 Crew No. 1, etc.
- 1 Crew interchanging at Node
- 1 Crew between Nodes on Line Legend:

- • Node
- = Double-wide transportation
- 1 Crew No. 1, etc.
- 1 Crew interchanging at Node
- 1 Crew between Nodes on Line

Figure 6

| I | III | V | ← Train → | | | II | IV | VI |
|---|---|---|---|---|---|---|---|---|
| Read Down | | | Route ↓ | | | Read Up | | |
| 0401 | 1201 | 2001 | leave | Point A | arrive | 1200 | 0400 | 2000 |
| 1 | 2 | 3 | ← | crew | → | 1 | 3 | 2 |
| 0800 | 1600 | 2400 | arrive | Point B | leave | 0801 | 0001 | 1601 |
| 0801 | 1601 | 0001 | leave | Point B | arrive | 0800 | 2400 | 1600 |
| 4 | 5 | 6 | ← | crew | → | 4 | 5 | 6 |
| 1200 | 2000 | 0400 | arrive | Point C | leave | 0401 | 2001 | 1201 |
| 1201 | 2001 | 0401 | leave | Point C | arrive | 0400 | 2000 | 1200 |
| 7 | 8 | 9 | ← | crew | → | 8 | 7 | 9 |
| 1600 | 2400 | 0800 | arrive | Point D | leave | 0001 | 1601 | 0801 |
| 1601 | 0001 | 0801 | leave | Point D | arrive | 2400 | 1600 | 0800 |
| 10 | 11 | 12 | ← | crew | → | 10 | 11 | 12 |
| 2000 | 0400 | 1200 | arrive | Point E | leave | 2001 | 1201 | 0401 |

FIGURE 9

| AI | AIII | AV | AVII | AIX | AXI | ---Relay--- | | | AII | AIV | AVI | AVIII | AX | AXII |
|---|---|---|---|---|---|---|---|---|---|---|---|---|---|---|
| | | Read Down | | | | Node | | | | | Read Up | | | |
| 2330 | 0330 | 0730 | 1130 | 1530 | 1930 | beg | 2' | end | 1130 | 1530 | 1930 | 2330 | 0330 | 0730 |
| A1 | A2 | A3 | A4 | A5 | A6 | | | | A2 | A3 | A4 | A5 | A6 | A1 |
| 0100 | 0500 | 0900 | 1300 | 1700 | 2100 | dep | 2' | arr | 1100 | 1500 | 1900 | 2300 | 0300 | 0700 |
| A1 | A2 | A3 | A4 | A5 | A6 | | | | A2 | A3 | A4 | A5 | A6 | A1 |
| 0300 | 0700 | 1100 | 1500 | 1900 | 2300 | arr | 11' | dep | 0900 | 1300 | 1700 | 2100 | 0100 | 0500 |
| A1 | A2 | A3 | A4 | A5 | A6 | | | | A2 | A3 | A4 | A5 | A6 | A1 |
| 0400 | 0800 | 1200 | 1600 | 2000 | 2400 | dep | 11' | arr | 0800 | 1200 | 1600 | 2000 | 2400 | 0400 |
| A7 | A8 | A9 | A10 | A11 | A12 | | | | A12 | A7 | A8 | A9 | A10 | A11 |
| 0700 | 1100 | 1500 | 1900 | 2300 | 0300 | arr | 20' | dep | 0500 | 0900 | 1300 | 1700 | 2100 | 0100 |
| A7 | A8 | A9 | A10 | A11 | A12 | | | | A12 | A7 | A8 | A9 | A10 | A11 |
| 0800 | 1200 | 1600 | 2000 | 2400 | 0400 | dep | 20' | arr | 0400 | 0800 | 1200 | 1600 | 2000 | 2400 |
| A13 | A14 | A15 | A16 | A17 | A18 | | | | A16 | A17 | A18 | A13 | A14 | A15 |
| 1100 | 1500 | 1900 | 2300 | 0300 | 0700 | arr | 25' | dep | 0100 | 0500 | 0900 | 1300 | 1700 | 2100 |
| A13 | A14 | A15 | A16 | A17 | A18 | | | | A16 | A17 | A18 | A13 | A14 | A15 |
| 1200 | 1600 | 2000 | 2400 | 0400 | 0800 | dep | 25' | arr | 2400 | 0400 | 0800 | 1200 | 1600 | 2000 |
| A19 | A20 | A21 | A22 | A23 | A24 | | | | A20 | A21 | A22 | A23 | A24 | A19 |
| 1600 | 2000 | 2400 | 0400 | 0800 | 1200 | arr | 32' | dep | 2000 | 2400 | 0400 | 0800 | 1200 | 1600 |
| A30 | A25 | A26 | A27 | A28 | A29 | | | | A25 | A26 | A27 | A28 | A29 | A30 |
| 1700 | 2100 | 0100 | 0500 | 0900 | 1300 | dep | 32' | arr | 1900 | 2300 | 0300 | 0700 | 1100 | 1500 |
| A30 | A25 | A26 | A27 | A28 | A29 | | | | A25 | A26 | A27 | A28 | A29 | A30 |
| 2000 | 2400 | 0400 | 0800 | 1200 | 1600 | arr | 38' | dep | 1600 | 2000 | 2400 | 0400 | 0800 | 1200 |
| A32 | A33 | A34 | A35 | A36 | A31 | | | | A31 | A32 | A33 | A34 | A35 | A36 |
| 2100 | 0100 | 0500 | 0900 | 1300 | 1700 | dep | 38' | arr | 1500 | 1900 | 2300 | 0300 | 0700 | 1100 |
| A32 | A33 | A34 | A35 | A36 | A31 | | | | A31 | A32 | A33 | A34 | A35 | A36 |
| 2400 | 0400 | 0800 | 1200 | 1600 | 2000 | arr | 53' | dep | 1200 | 1600 | 2000 | 2400 | 0400 | 0800 |
| A40 | A41 | A42 | A37 | A38 | A39 | | | | A37 | A38 | A39 | A40 | A41 | A42 |
| 0100 | 0500 | 0900 | 1300 | 1700 | 2100 | dep | 53' | arr | 1100 | 1500 | 1900 | 2300 | 0300 | 0700 |
| A40 | A41 | A42 | A37 | A38 | A39 | | | | A37 | A38 | A39 | A40 | A41 | A42 |
| 0400 | 0800 | 1200 | 1600 | 2000 | 2400 | arr | 56' | dep | 0800 | 1200 | 1600 | 2000 | 2400 | 0400 |
| A48 | A43 | A44 | A45 | A46 | A47 | | | | A43 | A44 | A45 | A46 | A47 | A48 |
| 0500 | 0900 | 1300 | 1700 | 2100 | 0100 | dep | 56' | arr | 0700 | 1100 | 1500 | 1900 | 2300 | 0300 |
| A48 | A43 | A44 | A45 | A46 | A47 | | | | A43 | A44 | A45 | A46 | A47 | A48 |
| 0630 | 1030 | 1430 | 1830 | 2230 | 0230 | arr | 57" | dep | 0530 | 0930 | 1330 | 1730 | 2130 | 0130 |
| A48 | A43 | A44 | A45 | A46 | A47 | | | | A43 | A44 | A45 | A46 | A47 | A48 |
| 0730 | 1130 | 1530 | 1930 | 1330 | 0333 | dep | 57" | arr | 0430 | 0830 | 1230 | 1630 | 2030 | 0030 |
| A48 | A43 | A44 | A45 | A46 | A47 | | | | A43 | A44 | A45 | A46 | A47 | A48 |
| 0800 | 1200 | 1600 | 2000 | 2400 | 0400 | arr | 58' | dep | 0400 | 0800 | 1200 | 1600 | 2000 | 2400 |
| YD | YD | YD | YD | YD | YD | | | | YD | YD | YD | YD | YD | YD |
| 0830 | 1230 | 1630 | 2030 | 0030 | 0430 | end | 58' | beg | 0230 | 0630 | 1030 | 1430 | 1830 | 2230 |

FIGURE 10

| BI | BIII | BV | BVII | BIX | BXI | ---Relay--- | | | BII | BIV | BVI | BVIII | BX | BXII |
|---|---|---|---|---|---|---|---|---|---|---|---|---|---|---|
| Read Down | | | | | | Node | | | Read Up | | | | | |
| 0130 | 0530 | 0930 | 1330 | 1730 | 2130 | beg | 2' | end | 0530 | 0930 | 1330 | 1730 | 2130 | 0130 |
| B1 | B2 | B3 | B4 | B5 | B6 | | | | B6 | B1 | B2 | B3 | B4 | B5 |
| 0300 | 0700 | 1100 | 1500 | 1900 | 2300 | dep | 2' | arr | 0500 | 0900 | 1300 | 1700 | 2100 | 0100 |
| B1 | B2 | B3 | B4 | B5 | B6 | | | | B6 | B1 | B2 | B3 | B4 | B5 |
| 0500 | 0900 | 1300 | 1700 | 2100 | 0100 | arr | 11' | dep | 0300 | 0700 | 1100 | 1500 | 1900 | 2300 |
| B1 | B2 | B3 | B4 | B5 | B6 | | | | B6 | B1 | B2 | B3 | B4 | B5 |
| 0600 | 1000 | 1400 | 1800 | 2200 | 0200 | dep | 11' | arr | 0200 | 0600 | 1000 | 1400 | 1800 | 2200 |
| B7 | B8 | B9 | B10 | B11 | B12 | | | | B10 | B11 | B12 | B7 | B8 | B9 |
| 0900 | 1300 | 1700 | 2100 | 0100 | 0500 | arr | 20' | dep | 2300 | 0300 | 0700 | 1100 | 1500 | 1900 |
| B7 | B8 | B9 | B10 | B11 | B12 | | | | B10 | B11 | B12 | B7 | B8 | B9 |
| 1000 | 1400 | 1800 | 2200 | 0200 | 0600 | dep | 20' | arr | 2200 | 0200 | 0600 | 1000 | 1400 | 1800 |
| B13 | B14 | B15 | B16 | B17 | B18 | | | | B14 | B15 | B16 | B17 | B18 | B13 |
| 1400 | 1800 | 2200 | 0200 | 0600 | 1000 | arr | 30' | dep | 1800 | 2200 | 0200 | 0600 | 1000 | 1400 |
| B24 | B19 | B20 | B21 | B22 | B23 | | | | B19 | B20 | B21 | B22 | B23 | B24 |
| 1500 | 1900 | 2300 | 0300 | 0700 | 1100 | dep | 30' | arr | 1700 | 2100 | 0100 | 0500 | 0900 | 1300 |
| B24 | B19 | B20 | B21 | B22 | B23 | | | | B19 | B20 | B21 | B22 | B23 | B24 |
| 1800 | 2200 | 0200 | 0600 | 1000 | 1400 | arr | 35' | dep | 1400 | 1800 | 2200 | 0200 | 0600 | 1000 |
| B26 | B27 | B28 | B29 | B30 | B25 | | | | B25 | B26 | B27 | B28 | B29 | B30 |
| 1900 | 2300 | 0300 | 0700 | 1100 | 1500 | dep | 35' | arr | 1300 | 1700 | 2100 | 0100 | 0500 | 0900 |
| B26 | B27 | B28 | B29 | B30 | B25 | | | | B25 | B26 | B27 | B28 | B29 | B30 |
| 2200 | 0200 | 0600 | 1000 | 1400 | 1800 | arr | 43' | dep | 1000 | 1400 | 1800 | 2200 | 0200 | 0600 |
| B34 | B35 | B36 | B31 | B32 | B33 | | | | B31 | B32 | B33 | B34 | B35 | B36 |
| 2300 | 0300 | 0700 | 1100 | 1500 | 1900 | dep | 43' | arr | 0900 | 1300 | 1700 | 2100 | 0100 | 0500 |
| B34 | B35 | B36 | B31 | B32 | B33 | | | | B31 | B32 | B33 | B34 | B35 | B36 |
| 0100 | 0500 | 0900 | 1300 | 1700 | 2100 | arr | 53' | dep | 0700 | 1100 | 1500 | 1900 | 2300 | 0300 |
| B34 | B35 | B36 | B31 | B32 | B33 | | | | B31 | B32 | B33 | B34 | B35 | B36 |
| 0200 | 0600 | 1000 | 1400 | 1800 | 2200 | dep | 53' | arr | 0600 | 1000 | 1400 | 1800 | 2200 | 0200 |
| B42 | B37 | B38 | B39 | B40 | B41 | | | | B37 | B38 | B39 | B40 | B41 | B42 |
| 0340 | 0740 | 1140 | 1540 | 1940 | 2340 | arr | 59' | dep | 0420 | 0820 | 1220 | 1620 | 2020 | 0020 |
| B42 | B37 | B38 | B39 | B40 | B41 | | | | B37 | B38 | B39 | B40 | B41 | B42 |
| 0440 | 0840 | 1240 | 1640 | 2040 | 0040 | dep | 59' | arr | 0320 | 0720 | 1120 | 1520 | 1920 | 2320 |
| B42 | B37 | B38 | B39 | B40 | B41 | | | | B37 | B58 | B39 | B40 | B41 | B42 |
| 0600 | 1000 | 1400 | 1800 | 2200 | 0200 | arr | 60" | dep | 0200 | 0600 | 1000 | 1400 | 1800 | 2230 |
| YD | YD | YD | YD | YD | YD | | | | YD | YD | YD | YD | YD | YD |
| 0630 | 1030 | 1430 | 1830 | 2230 | 0230 | end | 60' | beg | 0030 | 0430 | 0830 | 1230 | 1630 | 2030 |

FIGURE 11

| CI | CIII | CV | CVII | CIX | CXI | ---Relay--- | | | CII | CIV | CVI | CVIII | CX | CXII |
|---|---|---|---|---|---|---|---|---|---|---|---|---|---|---|
| | | Read Down | | | | | Node | | | | Read Up | | | |
| 0030 | 0430 | 0830 | 1230 | 1630 | 2030 | beg | 2' | end | 0230 | 0630 | 1030 | 1430 | 1830 | 2230 |
| YD | YD | YD | YD | YD | YD | | | | YD | YD | YD | YD | YD | YD |
| 0200 | 0600 | 1000 | 1400 | 1800 | 2200 | dep | 2' | arr | 0200 | 0600 | 1000 | 1400 | 1800 | 2200 |
| C1 | C2 | C3 | C4 | C5 | C6 | | | | C5 | C6 | C1 | C2 | C3 | C4 |
| 0500 | 0900 | 1300 | 1700 | 2100 | 0100 | arr | 14' | dep | 2300 | 0300 | 0700 | 1100 | 1500 | 1900 |
| C1 | C2 | C3 | C4 | C5 | C6 | | | | C5 | C6 | C1 | C2 | C3 | C4 |
| 0600 | 1000 | 1400 | 1800 | 2200 | 0200 | dep | 14' | arr | 2200 | 0200 | 0600 | 1000 | 1400 | 1800 |
| C7 | C8 | C9 | C10 | C11 | C12 | | | | C9 | C10 | C11 | C12 | C7 | C8 |
| 0900 | 1300 | 1700 | 2100 | 0100 | 0500 | arr | 24' | dep | 1900 | 2300 | 0300 | 0700 | 1100 | 1500 |
| C7 | C8 | C9 | C10 | C11 | C12 | | | | C9 | C10 | C11 | C12 | C7 | C8 |
| 1000 | 1400 | 1800 | 2200 | 0200 | 0600 | dep | 24' | arr | 1800 | 2200 | 0200 | 0600 | 1000 | 1400 |
| C13 | C14 | C15 | C16 | C17 | C18 | | | | C13 | C14 | C15 | C16 | C17 | C18 |
| 1300 | 1700 | 2100 | 0100 | 0500 | 0900 | arr | 29' | dep | 1500 | 1900 | 2300 | 0300 | 0700 | 1100 |
| C13 | C14 | C15 | C16 | C17 | C18 | | | | C13 | C14 | C15 | C16 | C17 | C18 |
| 1400 | 1800 | 2200 | 0200 | 0600 | 1000 | dep | 29' | arr | 1400 | 1800 | 2200 | 0200 | 0600 | 1000 |
| C19 | C20 | C21 | C22 | C23 | C24 | | | | C23 | C24 | C19 | C20 | C21 | C22 |
| 1800 | 2200 | 0200 | 0600 | 1000 | 1400 | arr | 34' | dep | 1100 | 1500 | 1900 | 2300 | 0300 | 0700 |
| C25 | C26 | C27 | C28 | C29 | C30 | | | | C23 | C24 | C19 | C20 | C21 | C22 |
| 1900 | 2300 | 0300 | 0700 | 1100 | 1500 | dep | 34' | arr | 1000 | 1400 | 1800 | 2200 | 0200 | 0600 |
| C25 | C26 | C27 | C28 | C29 | C30 | | | | C27 | C28 | C29 | C30 | C25 | C26 |
| 2200 | 0200 | 0600 | 1000 | 1400 | 1800 | arr | 41' | dep | 0600 | 1000 | 1400 | 1800 | 2200 | 0200 |
| YD | YD | YD | YD | YD | YD | | | | YD | YD | YD | YD | YD | YD |
| 2300 | 0300 | 0700 | 1100 | 1500 | 1900 | dep | 41' | arr | 0500 | 0900 | 1300 | 1700 | 2100 | 0100 |
| C31 | C32 | C33 | C34 | C35 | C36 | | | | G41 | G42 | G37 | G38 | G39 | G40 |
| 0300 | 0700 | 1100 | 1500 | 1900 | 2300 | arr | 52' | dep | 0100 | 0500 | 0900 | 1300 | 1700 | 2100 |
| YD | YD | YD | YD | YD | YD | | | | YD | YD | YD | YD | YD | YD |
| 0330 | 0730 | 1130 | 1530 | 1930 | 2300 | end | 52' | beg | 2230 | 0330 | 0730 | 1130 | 1530 | 1930 |

FIGURE 12

| DI | DIII | DV | DVII | DIX | DXI | ---Relay--- | | | DII | DIV | DVI | DVIII | DX | DXII |
|---|---|---|---|---|---|---|---|---|---|---|---|---|---|---|
| | | Read Down | | | | Node | | | | | Read Up | | | |
| 2330 | 0330 | 0730 | 1130 | 1530 | 1930 | beg | 1' | end | 0530 | 0930 | 1330 | 1730 | 2130 | 0130 |
| YD | YD | YD | YD | YD | YD | | | | YD | YD | YD | YD | YD | YD |
| 0100 | 0500 | 0900 | 1300 | 1700 | 2100 | dep | 1' | arr | 0500 | 0900 | 1300 | 1700 | 2100 | 0100 |
| D1 | D2 | D3 | D4 | D5 | D6 | | | | D6 | D1 | D2 | D3 | D4 | D5 |
| 0400 | 0800 | 1200 | 1600 | 2000 | 2400 | arr | 11' | dep | 0200 | 0600 | 1000 | 1400 | 1800 | 2200 |
| D1 | D2 | D3 | D4 | D5 | D6 | | | | D6 | D1 | D2 | D3 | D4 | D5 |
| 0500 | 0900 | 1300 | 1700 | 2100 | 0100 | dep | 11' | arr | 0100 | 0500 | 0900 | 1300 | 1700 | 2100 |
| D7 | D8 | D9 | D10 | D11 | D12 | | | | D10 | D11 | D12 | D7 | D8 | D9 |
| 0800 | 1200 | 1600 | 2000 | 2400 | 0400 | arr | 20' | dep | 2200 | 0200 | 0600 | 1000 | 1400 | 1800 |
| D7 | D8 | D9 | D10 | D11 | D12 | | | | D10 | D11 | D12 | D7 | D8 | D9 |
| 0900 | 1300 | 1700 | 2100 | 0100 | 0500 | dep | 20' | arr | 2100 | 0100 | 0500 | 0900 | 1300 | 1700 |
| D13 | D14 | D15 | D16 | D17 | D18 | | | | D14 | D15 | D16 | D17 | D18 | D13 |
| 1200 | 1600 | 2000 | 2400 | 0400 | 0800 | arr | 25' | dep | 1800 | 2200 | 0200 | 0600 | 1000 | 1400 |
| D13 | D14 | D15 | D16 | D17 | D18 | | | | D14 | D15 | D16 | D17 | D18 | D13 |
| 1300 | 1700 | 2100 | 0100 | 0500 | 0900 | dep | 25' | arr | 1700 | 2100 | 0100 | 0500 | 0900 | 1300 |
| D19 | D20 | D21 | D22 | D23 | D24 | | | | D24 | D19 | D20 | D21 | D22 | D23 |
| 1600 | 2000 | 2400 | 0400 | 0800 | 1200 | arr | 29' | dep | 1400 | 1800 | 2200 | 0200 | 0600 | 1000 |
| D19 | D20 | D21 | D22 | D23 | D24 | | | | D24 | D19 | D20 | D21 | D22 | D23 |
| 1700 | 2100 | 0100 | 0500 | 0900 | 1300 | dep | 29' | arr | 1300 | 1700 | 2100 | 0100 | 0500 | 0900 |
| D25 | D26 | D27 | D28 | D29 | D30 | | | | D28 | D29 | D30 | D25 | D26 | D27 |
| 2100 | 0100 | 0500 | 0900 | 1300 | 1700 | arr | 34' | dep | 1000 | 1400 | 1800 | 2200 | 0200 | 0600 |
| D25 | D26 | D27 | D28 | D29 | D30 | | | | D31 | D32 | D33 | D34 | D35 | D36 |
| 2200 | 0200 | 0600 | 1000 | 1400 | 1800 | dep | 34' | arr | 0900 | 1300 | 1700 | 2100 | 0100 | 0500 |
| D34 | D35 | D36 | D31 | D32 | D33 | | | | D31 | D32 | D33 | D34 | D35 | D36 |
| 0100 | 0500 | 0900 | 1300 | 1700 | 2100 | arr | 41' | dep | 0500 | 0900 | 1300 | 1700 | 2100 | 0100 |
| D42 | D37 | D38 | D39 | D40 | D41 | | | | D37 | D38 | D39 | D40 | D41 | D42 |
| 0200 | 0600 | 1000 | 1400 | 1800 | 2200 | dep | 41' | arr | 0400 | 0800 | 1200 | 1600 | 2000 | 2400 |
| D42 | D37 | D38 | D39 | D40 | D41 | | | | D37 | D38 | D39 | D40 | D41 | D42 |
| 0400 | 0800 | 1200 | 1600 | 2000 | 2400 | arr | 48' | dep | 0200 | 0600 | 1000 | 1400 | 1800 | 2200 |
| D42 | D37 | D38 | D39 | D40 | D41 | | | | D37 | D38 | D39 | D40 | D41 | D42 |
| 0500 | 0900 | 1300 | 1700 | 2100 | 0100 | end | 48' | beg | 0030 | 0430 | 0830 | 1230 | 1630 | 2030 |

FIGURE 13

| EI | EIII | EV | EVII | EIX | EXI | ---Relay--- | | | EII | EIV | EVI | EVIII | EX | EXII |
|---|---|---|---|---|---|---|---|---|---|---|---|---|---|---|
| | | Read Down | | | | | Node | | | | Read Up | | | |
| 0130 | 0530 | 0930 | 1330 | 1730 | 2130 | beg | 4' | end | 0330 | 0730 | 1130 | 1530 | 1930 | 2330 |
| YD | YD | YD | YD | YD | YD | | | | YD | YD | YD | YD | YD | YD |
| 0300 | 0700 | 1100 | 1500 | 1900 | 2300 | dep | 4' | arr | 0300 | 0700 | 1100 | 1500 | 1900 | 2300 |
| E1 | E2 | E3 | E4 | E5 | E6 | | | | E5 | E6 | E1 | E2 | E3 | E4 |
| 0410 | 0810 | 1210 | 1610 | 2010 | 0010 | arr | 8' | dep | 0150 | 0550 | 0950 | 1350 | 1750 | 2150 |
| E1 | E2 | E3 | E4 | E5 | E6 | | | | E5 | E6 | E1 | E2 | E3 | E4 |
| 0510 | 0910 | 1310 | 1710 | 2110 | 0110 | dep | 8' | arr | 0500 | 0450 | 0850 | 1250 | 1650 | 2050 |
| E1 | E2 | E3 | E4 | E5 | E6 | | | | E5 | E6 | E1 | E2 | E3 | E4 |
| 0600 | 1000 | 1400 | 1800 | 2200 | 0200 | arr | 12' | dep | 2400 | 0400 | 0800 | 1200 | 1600 | 2000 |
| E1 | E2 | E3 | E4 | E5 | E6 | | | | E5 | E6 | E1 | E2 | E3 | E4 |
| 0700 | 1100 | 1500 | 1900 | 2300 | 0300 | dep | 12' | arr | 2300 | 0300 | 0700 | 1100 | 1500 | 1900 |
| E7 | E8 | E9 | E10 | E11 | E12 | | | | E9 | E10 | E11 | E12 | E7 | E8 |
| 1000 | 1400 | 1800 | 2200 | 0200 | 0600 | arr | 24' | dep | 2000 | 2400 | 0400 | 0800 | 1200 | 1600 |
| E7 | E8 | E9 | E10 | E11 | E12 | | | | E9 | E10 | E11 | E12 | E7 | E8 |
| 1100 | 1500 | 1900 | 2300 | 0300 | 0700 | dep | 24' | arr | 1900 | 2300 | 0300 | 0700 | 1100 | 1500 |
| E13 | E14 | E15 | E16 | E17 | E18 | | | | E13 | E14 | E15 | E16 | E17 | E18 |
| 1400 | 1800 | 2200 | 0200 | 0600 | 1000 | arr | 29' | dep | 1600 | 2000 | 2400 | 0400 | 0800 | 1200 |
| E13 | E14 | E15 | E16 | E17 | E18 | | | | E13 | E14 | E15 | E16 | E17 | E18 |
| 1500 | 1900 | 2300 | 0300 | 0700 | 1100 | dep | 29' | arr | 1500 | 1900 | 2300 | 0300 | 0700 | 1100 |
| E19 | E20 | E21 | E22 | E23 | E24 | | | | E23 | E24 | E19 | E20 | E21 | E22 |
| 1900 | 2300 | 0300 | 0700 | 1100 | 1500 | arr | 34' | dep | 1200 | 1600 | 2000 | 2400 | 0400 | 0800 |
| E19 | E20 | E21 | E22 | E23 | E24 | | | | E25 | E26 | E27 | E28 | E29 | E30 |
| 2000 | 2400 | 0400 | 0800 | 1200 | 1600 | dep | 34' | arr | 1100 | 1500 | 1900 | 2300 | 0300 | 0700 |
| E27 | E28 | E29 | E30 | E25 | E26 | | | | E25 | E26 | E27 | E28 | E29 | E30 |
| 2300 | 0300 | 0700 | 1100 | 1500 | 1900 | arr | 41' | dep | 0700 | 1100 | 1500 | 1900 | 2300 | 0300 |
| E35 | E36 | E31 | E32 | E33 | E34 | | | | E31 | E32 | E33 | E34 | E35 | E36 |
| 2400 | 0400 | 0800 | 1200 | 1600 | 2000 | dep | 41' | arr | 0600 | 1000 | 1400 | 1800 | 2200 | 0200 |
| E35 | E36 | E31 | E32 | E33 | E34 | | | | E31 | E32 | E33 | E34 | E35 | E36 |
| 0300 | 0700 | 1100 | 1600 | 1900 | 2300 | arr | 51' | dep | 0300 | 0700 | 1100 | 1500 | 1900 | 2300 |
| YD | YD | YD | YD | YD | YD | | | | YD | YD | YD | YD | YD | YD |
| 0330 | 0730 | 1130 | 1530 | 1930 | 2330 | end | 51' | beg | 0130 | 0530 | 0930 | 1330 | 1730 | 2130 |

FIGURE 14

| FI | FIII | FV | FVII | FIX | FXI | ---Relay--- | FII | FIV | FVI | FVIII | FX | FXII |
|---|---|---|---|---|---|---|---|---|---|---|---|---|
| Read Down | | | | | | Node | Read Up | | | | | |
| | 0600 | | 1400 | | 2200 | dep 6' arr | 1400 | | 2200 | | 0600 | |
| | F2 | | F4 | | F6 | | F2 | | F4 | | F6 | |
| 0200 | | 1000 | | 1800 | | dep 5' arr | | 1800 | | 0200 | | 1000 |
| F1 | | F3 | | F5 | | | | F3 | | F5 | | F1 |
| 0500 | 0900 | 1300 | 1700 | 2100 | 0100 | arr 8' dep | 1100 | 1500 | 1900 | 2300 | 0300 | 0700 |
| F1 | F2 | F3 | F4 | F5 | F6 | | F2 | F3 | F4 | F5 | F6 | F1 |
| 0600 | 1000 | 1400 | 1800 | 2200 | 0200 | dep 8' arr | 1000 | 1400 | 1800 | 2200 | 0200 | 0600 |
| F7 | F8 | F9 | F10 | F11 | F12 | | F12 | F7 | F8 | F9 | F10 | F11 |
| 0900 | 1300 | 1700 | 2100 | 0100 | 0500 | arr 17' dep | 0700 | 1100 | 1500 | 1900 | 2300 | 0300 |
| F7 | F8 | F9 | F10 | F11 | F12 | | F12 | F7 | F8 | F9 | F10 | F11 |
| 1000 | 1400 | 1800 | 2200 | 0200 | 0600 | dep 17' arr | 0600 | 1000 | 1400 | 1800 | 2200 | 0200 |
| F13 | F14 | F15 | F16 | F17 | F18 | | F16 | F17 | F18 | F13 | F14 | F15 |
| 1300 | 1700 | 2100 | 0100 | 0500 | 0900 | arr 25' dep | 0300 | 0700 | 1100 | 1500 | 1900 | 2300 |
| F13 | F14 | F15 | F16 | F17 | F18 | | F16 | F17 | F18 | F13 | F14 | F15 |
| 1400 | 1800 | 2200 | 0200 | 0600 | 1000 | dep 25' arr | 0200 | 0600 | 1000 | 1400 | 1800 | 2200 |
| F19 | F20 | F21 | F22 | F23 | F24 | | F20 | F21 | F22 | F23 | F24 | F19 |
| 1800 | 2200 | 0200 | 0600 | 1000 | 1400 | arr 32' dep | 2200 | 0200 | 0600 | 1000 | 1400 | 1800 |
| F30 | F25 | F26 | F27 | F28 | F29 | | F25 | F26 | F27 | F28 | F29 | F30 |
| 1900 | 2300 | 0300 | 0700 | 1100 | 1500 | dep 32' arr | 2100 | 0100 | 0500 | 0900 | 1300 | 1700 |
| F30 | F25 | F26 | F27 | F28 | F29 | | F25 | F26 | F27 | F28 | F29 | F30 |
| 2200 | 0200 | 0600 | 1000 | 1400 | 1800 | arr 38' dep | 1800 | 2200 | 0200 | 0600 | 1000 | 1400 |
| F32 | F33 | F34 | F35 | F36 | F31 | | F31 | F32 | F33 | F34 | F35 | F36 |
| 2300 | 0300 | 0700 | 1100 | 1500 | 1900 | dep 38' arr | 1700 | 2100 | 0100 | 0500 | 0900 | 1300 |
| F32 | F33 | F34 | F35 | F36 | F31 | | F31 | F32 | F33 | F34 | F35 | F36 |
| 0200 | 0600 | 1000 | 1400 | 1800 | 2200 | arr 53' dep | 1400 | 1800 | 2200 | 0200 | 0600 | 1000 |
| F40 | F41 | F42 | F37 | F38 | F39 | | F37 | F38 | F39 | F40 | F41 | F42 |
| 0300 | 0700 | 1100 | 1500 | 1900 | 2300 | dep 53' arr | 1300 | 1700 | 2100 | 0100 | 0500 | 0900 |
| F40 | F41 | F42 | F37 | F38 | F39 | | F37 | F38 | F39 | F40 | F41 | F42 |
| 0600 | 1000 | 1400 | 1800 | 2200 | 0200 | arr 54' dep | 1000 | 1400 | 1800 | 2200 | 0200 | 0600 |
| F48 | F43 | F44 | F45 | F46 | F47 | | F43 | F44 | F45 | F46 | F47 | F48 |
| 0700 | 1100 | 1500 | 1900 | 2300 | 0300 | dep 54' arr | 0900 | 1300 | 1700 | 2100 | 0100 | 0500 |
| F48 | F43 | F44 | F45 | F46 | F47 | | F43 | F44 | F45 | F46 | F47 | F48 |
| 0750 | 1150 | 1550 | 1950 | 2350 | 0350 | arr 55" dep | 0810 | 1210 | 1610 | 2010 | 0010 | 0410 |
| F48 | F43 | F44 | F45 | F46 | F47 | | F43 | F44 | F45 | F46 | F47 | F48 |
| 0850 | 1250 | 1650 | 2050 | 0050 | 0450 | dep 55" arr | 0710 | 1110 | 1510 | 1910 | 2310 | 0310 |
| F48 | F43 | F44 | F45 | F46 | F47 | | F43 | F44 | F45 | F46 | F47 | F48 |
| 1000 | 1400 | 1800 | 2200 | 0200 | 0600 | arr 48' dep | 0600 | 1000 | 1400 | 1800 | 2200 | 0200 |
| F50 | F51 | F52 | F53 | F54 | F49 | | F49 | F50 | F51 | F52 | F53 | F54 |
| 1100 | 1500 | 1900 | 2300 | 0300 | 0700 | dep 48' arr | 0500 | 0900 | 1300 | 1700 | 2100 | 0100 |
| F50 | F51 | F52 | F53 | F54 | F49 | | F49 | F50 | F51 | F52 | F53 | F54 |
| 1200 | 1600 | 2000 | 2400 | 0400 | 0800 | arr 49" dep | 0400 | 0800 | 1200 | 1600 | 2000 | 2400 |
| F50 | F51 | F52 | F53 | F54 | F49 | | F49 | F50 | F51 | F52 | F53 | F54 |
| 1300 | 1700 | 2100 | 0100 | 0500 | 0900 | dep 49" arr | 0300 | 0700 | 1100 | 1500 | 1900 | 2300 |
| F50 | F51 | F52 | F53 | F54 | F55 | | F49 | F50 | F51 | F52 | F53 | F54 |
| 1400 | 1800 | 2200 | 0200 | 0600 | 1000 | arr 50' dep | 0200 | 0600 | 1000 | 1400 | 1800 | 2200 |
| YD | YD | YD | YD | YD | YD | | YD | YD | YD | YD | YD | YD |
| 1430 | 1830 | 2230 | 0230 | 0630 | 1030 | end 50' beg | 0030 | 0430 | 0830 | 1230 | 1630 | 2030 |

FIGURE 15

| GI | GIII | GV | GVII | GIX | GXI | ---Relay--- | | | GII | GIV | GVI | GVIII | GX | GXII |
|---|---|---|---|---|---|---|---|---|---|---|---|---|---|---|
| Read Down | | | | | | Node | | | Read Up | | | | | |
| 0030 | 0430 | 0830 | 1230 | 1630 | 2030 | beg | 7' | end | 1030 | 1430 | 1830 | 2230 | 0230 | 0630 |
| YD | YD | YD | YD | YD | YD | | | | YD | YD | YD | YD | YD | YD |
| 0200 | 0600 | 1000 | 1400 | 1800 | 2200 | dep | 7' | arr | 1000 | 1400 | 1800 | 2200 | 0200 | 0600 |
| G1 | G2 | G3 | G4 | G5 | G6 | | | | G1 | G2 | G3 | G4 | G5 | G6 |
| 0500 | 0900 | 1300 | 1700 | 2100 | 0100 | arr | 4' | dep | 0700 | 1100 | 1500 | 1900 | 2300 | 0300 |
| G1 | G2 | G3 | G4 | G5 | G6 | | | | G1 | G2 | G3 | G4 | G5 | G6 |
| 0600 | 1000 | 1400 | 1800 | 2200 | 0200 | dep | 4' | arr | 0600 | 1000 | 1400 | 1800 | 2200 | 0200 |
| J22 | J23 | J24 | J19 | J20 | J21 | | | | J21 | J22 | J23 | J24 | J19 | J20 |
| 0700 | 1100 | 1500 | 1900 | 2300 | 0300 | arr | 8' | dep | 0500 | 0900 | 1300 | 1700 | 2100 | 0100 |
| J22 | J23 | J24 | J19 | J20 | J21 | | | | J21 | J22 | J23 | J24 | J19 | J20 |
| 0800 | 1200 | 1600 | 2000 | 2400 | 0400 | dep | 8' | arr | 0400 | 0800 | 1200 | 1600 | 2000 | 2400 |
| G7 | G8 | G9 | G10 | G11 | G12 | | | | G10 | G11 | G12 | G7 | G8 | G9 |
| 1100 | 1500 | 1900 | 2300 | 0300 | 0700 | arr | 15' | dep | 0100 | 0500 | 0900 | 1300 | 1700 | 2100 |
| G7 | G8 | G9 | G10 | G11 | G12 | | | | G10 | G11 | G12 | G7 | G8 | G9 |
| 1200 | 1600 | 2000 | 2400 | 0400 | 0800 | dep | 15' | arr | 2400 | 0400 | 0800 | 1200 | 1600 | 2000 |
| G13 | G14 | G15 | G16 | G17 | G18 | | | | G14 | G15 | G16 | G17 | G18 | G13 |
| 1300 | 1700 | 2100 | 0100 | 0500 | 0900 | arr | 16" | dep | 2300 | 0300 | 0700 | 1100 | 1500 | 1900 |
| G13 | G14 | G15 | G16 | G17 | G18 | | | | G14 | G15 | G16 | G17 | G18 | G13 |
| 1400 | 1800 | 2200 | 0200 | 0600 | 1000 | dep | 16" | arr | 2200 | 0200 | 0600 | 1000 | 1400 | 1800 |
| G13 | G14 | G15 | G16 | G17 | G18 | | | | G14 | G15 | G16 | G17 | G18 | G13 |
| 1500 | 1900 | 2300 | 0300 | 0700 | 1100 | arr | 21' | dep | 2100 | 0100 | 0500 | 0900 | 1300 | 1700 |
| G13 | G14 | G15 | G16 | G17 | G18 | | | | G14 | G15 | G16 | G17 | G18 | G13 |
| 1600 | 2000 | 2400 | 0400 | 0800 | 1200 | dep | 21' | arr | 2000 | 2400 | 0400 | 0800 | 1200 | 1600 |
| G19 | G20 | G21 | G22 | G23 | G24 | | | | G24 | G19 | G20 | G21 | G22 | G23 |
| 1900 | 2300 | 0300 | 0700 | 1100 | 1500 | arr | 26' | dep | 1700 | 2100 | 0100 | 0500 | 0900 | 1300 |
| G19 | G20 | G21 | G22 | G23 | G24 | | | | G24 | G19 | G20 | G21 | G22 | G23 |
| 2000 | 2400 | 0400 | 0800 | 1200 | 1600 | dep | 26' | arr | 1600 | 2000 | 2400 | 0400 | 0800 | 1200 |
| G25 | G26 | G27 | G28 | G29 | G30 | | | | G28 | G29 | G30 | G25 | G26 | G27 |
| 2400 | 0400 | 0800 | 1200 | 1600 | 2000 | arr | 34' | dep | 1300 | 1700 | 2100 | 0100 | 0500 | 0900 |
| G31 | G32 | G33 | G34 | G35 | G36 | | | | G28 | G29 | G30 | G25 | G26 | G27 |
| 0100 | 0500 | 0900 | 1300 | 1700 | 2100 | dep | 34' | arr | 1200 | 1600 | 2000 | 2400 | 0400 | 0800 |
| G31 | G32 | G33 | G34 | G35 | G36 | | | | G32 | G33 | G34 | G35 | G36 | G31 |
| 0400 | 0800 | 1200 | 1600 | 2000 | 2400 | arr | 41' | dep | 0800 | 1200 | 1600 | 2000 | 2400 | 0400 |
| YD | YD | YD | YD | YD | YD | | | | YD | YD | YD | YD | YD | YD |
| 0500 | 0900 | 1300 | 1700 | 2100 | 0100 | dep | 41' | arr | 0700 | 1100 | 1500 | 1900 | 2300 | 0300 |
| G37 | G38 | G39 | G40 | G41 | G42 | | | | C31 | C32 | C33 | C34 | C35 | C36 |
| 0900 | 1300 | 1700 | 2100 | 0100 | 0500 | arr | 52' | dep | 0300 | 0700 | 1100 | 1500 | 1900 | 2300 |
| YD | YD | YD | YD | YD | YD | | | | YD | YD | YD | YD | YD | YD |
| 0930 | 1330 | 1730 | 2130 | 0130 | 0530 | end | 52' | beg | 0130 | 0530 | 0930 | 1330 | 1730 | 2130 |

FIGURE 16

| HI | HIII | HV | ---Relay--- | HII | HIV | HVI |
|---|---|---|---|---|---|---|
| | Read Down | | Node | | Read Up | |
| 2330 | 0730 | 1530 | beg 24' end | 0730 | 1530 | 2330 |
| H1 | H2 | H3 | | H1 | H2 | H3 |
| 0100 | 0900 | 1700 | dep 24' arr | 0700 | 1500 | 2300 |
| H1 | H2 | H3 | | H1 | H2 | H3 |
| 0400 | 1200 | 2000 | arr 28' dep | 0400 | 1200 | 2000 |
| H4 | H5 | H6 | | H6 | H4 | H5 |
| 0500 | 1300 | 2100 | dep 28' arr | 0300 | 1100 | 1900 |
| H4 | H5 | H6 | | H6 | H4 | H5 |
| 0600 | 1400 | 2200 | arr 31" dep | 0200 | 1000 | 1800 |
| H4 | H5 | H6 | | H6 | H4 | H5 |
| 0700 | 1500 | 2300 | dep 31" arr | 0100 | 0900 | 1700 |
| H4 | H5 | H6 | | H6 | H4 | H5 |
| 0800 | 1600 | 2400 | arr 33"'dep | 2400 | 0800 | 1600 |
| 0800 | 1600 | 2400 | dep 33"'arr | 2400 | 0800 | 1600 |
| H7 | H8 | H9 | | H8 | H9 | H7 |
| 1100 | 1900 | 0300 | arr 36' dep | 2100 | 0500 | 1300 |
| H7 | H8 | H9 | | H8 | H9 | H7 |
| 1200 | 2000 | 0400 | dep 36' arr | 2000 | 0400 | 1200 |
| H10 | H11 | H12 | | H10 | H11 | H12 |
| 1500 | 2300 | 0700 | arr 39' dep | 1700 | 0100 | 0900 |
| H10 | H11 | H12 | | H10 | H11 | H12 |
| 1600 | 2400 | 0800 | dep 39' arr | 1600 | 2400 | 0800 |
| H13 | H14 | H15 | | H15 | H13 | H14 |
| 1900 | 0300 | 1100 | arr 44' dep | 1300 | 2100 | 0500 |
| H13 | H14 | H15 | | H15 | H13 | H14 |
| 2000 | 0400 | 1200 | dep 44' arr | 1200 | 2000 | 0400 |
| H16 | H17 | H18 | | H17 | H18 | H16 |
| 2400 | 0800 | 1600 | arr 46' dep | 0800 | 1600 | 2400 |
| H21 | H19 | H20 | | H19 | H20 | H21 |
| 0100 | 0900 | 1700 | dep 46' arr | 0700 | 1500 | 2300 |
| H21 | H19 | H20 | | H19 | H20 | H21 |
| 0400 | 1200 | 2000 | arr 52' dep | 0530 | 1730 | 0130 |
| YD | YD | YD | | YD | YD | YD |
| 0430 | 1230 | 2030 | 52' | 0230 | 1030 | 1830 |

FIGURE 17

| JI | JIII | JV | JVII | JIX | JXI | ---Relay--- | | | JII | JIV | JVI | JVIII | JX | JXII |
|---|---|---|---|---|---|---|---|---|---|---|---|---|---|---|
| | | Read Down | | | | Node | | | | | Read Up | | | |
| 0230 | 0630 | 1030 | 1430 | 1830 | 2230 | beg | 19' | end | 2030 | 0030 | 0430 | 0830 | 1230 | 1630 |
| YD | YD | YD | YD | YD | YD | | | | YD | YD | YD | YD | YD | YD |
| 0400 | 0800 | 1200 | 1600 | 2000 | 2400 | dep | 19' | arr | 2000 | 2400 | 0400 | 0800 | 1200 | 1600 |
| J1 | J2 | J3 | J4 | J5 | J6 | | | | J3 | J4 | J5 | J6 | J1 | J2 |
| 0700 | 1100 | 1500 | 1900 | 2300 | 0300 | arr | 10' | dep | 1700 | 2100 | 0100 | 0500 | 0900 | 1300 |
| J1 | J2 | J3 | J4 | J5 | J6 | | | | J3 | J4 | J5 | J6 | J1 | J2 |
| 0800 | 1200 | 1600 | 2000 | 2400 | 0400 | dep | 10' | arr | 1600 | 2000 | 2400 | 0400 | 0800 | 1200 |
| J7 | J8 | J9 | J10 | J11 | J12 | | | | J7 | J8 | J9 | J10 | J11 | J12 |
| 1100 | 1500 | 1900 | 2300 | 0300 | 0700 | arr | 2' | dep | 1300 | 1700 | 2100 | 0100 | 0500 | 0900 |
| J7 | J8 | J9 | J10 | J11 | J12 | | | | J7 | J8 | J9 | J10 | J11 | J12 |
| 1200 | 1600 | 2000 | 2400 | 0400 | 0800 | dep | 2' | arr | 1200 | 1600 | 2000 | 2400 | 0400 | 0800 |
| J13 | J14 | J15 | J16 | J17 | J18 | | | | J17 | J18 | J13 | J14 | J15 | J16 |
| 1500 | 1900 | 2300 | 0300 | 0700 | 1100 | arr | 3' | dep | 0900 | 1300 | 1700 | 2100 | 0100 | 0500 |
| J13 | J14 | J15 | J16 | J17 | J18 | | | | J17 | J18 | J13 | J14 | J15 | J16 |
| 1600 | 2000 | 2400 | 0400 | 0800 | 1200 | dep | 3' | arr | 0800 | 1200 | 1600 | 2000 | 2400 | 0400 |
| J19 | J20 | J21 | J22 | J23 | J24 | | | | J21 | J22 | J23 | J24 | J19 | J20 |
| 1700 | 2100 | 0100 | 0500 | 0900 | 1300 | arr | 4' | dep | 0700 | 1100 | 1500 | 1900 | 2300 | 0300 |
| J19 | J20 | J21 | J22 | J23 | J24 | | | | J21 | J22 | J23 | J24 | J19 | J20 |
| 1800 | 2200 | 0200 | 0600 | 1000 | 1400 | dep | 4' | arr | 0600 | 1000 | 1400 | 1800 | 2200 | 0200 |
| J25 | J26 | J27 | J28 | J29 | J30 | | | | J26 | J27 | J28 | J29 | J30 | J25 |
| 2130 | 0130 | 0530 | 0930 | 1330 | 1730 | dep | 7' | beg | 0130 | 0530 | 0930 | 1330 | 1730 | 2130 |

FIGURE 18

| KI | KIII | KV | ---Relay--- | KII | KIV | KVI |
|---|---|---|---|---|---|---|
| | Read Down | | Node | | Read Up | |
| 0230 | 1030 | 1830 | beg 9' end | 2030 | 0430 | 1230 |
| YD | YD | YD | | YD | YD | YD |
| 0400 | 1200 | 2000 | dep 9' arr | 2000 | 0400 | 1200 |
| K8 | K9 | K7 | | K7 | K8 | K9 |
| 0530 | 1330 | 2130 | arr 10" dep | 1830 | 0230 | 1030 |
| K8 | K9 | K7 | | K7 | K8 | K9 |
| 0630 | 1430 | 2230 | dep 10" arr | 1730 | 0130 | 0930 |
| K8 | K9 | K7 | | K7 | K8 | K9 |
| 0800 | 1600 | 2400 | arr 11' dep | 1600 | 2400 | 0800 |
| K6 | K4 | K5 | | K4 | K5 | K6 |
| 0900 | 1700 | 0100 | dep 11' arr | 1500 | 2300 | 0700 |
| K6 | K4 | K5 | | K4 | K5 | K6 |
| 1200 | 2000 | 0400 | arr 12' dep | 1200 | 2000 | 0400 |
| K1 | K2 | K3 | | K1 | K2 | K3 |
| 1300 | 2100 | 0500 | dep 12' arr | 1100 | 1900 | 0300 |
| K1 | K2 | K3 | | K1 | K2 | K3 |
| 1600 | 2400 | 0800 | arr 13' dep | 0800 | 1600 | 2400 |
| YD | YD | YD | | YD | YD | YD |
| 1630 | 0030 | 0830 | end 13' beg | 0630 | 1430 | 2230 |

FIGURE 19

| LI | LIII | LV | LVII | LIX | LXI | ---Relay--- | LII | LIV | LVI | LVIII | LX | LXII |
|---|---|---|---|---|---|---|---|---|---|---|---|---|
| | | Read Down | | | | Node | | | Read Up | | | |
| 0130 | 0530 | 0930 | 1330 | 1730 | 2130 | beg 19' end | 1130 | 1530 | 1930 | 2330 | 0330 | 0750 |
| YD | YD | YD | YD | YD | YD | | YD | YD | YD | YD | YD | YD |
| 0300 | 0700 | 1100 | 1500 | 1900 | 2300 | dep 19' arr | 1100 | 1500 | 1900 | 2300 | 0300 | 0700 |
| L1 | L2 | L3 | L4 | L5 | L6 | | L1 | L2 | L3 | L4 | L5 | L6 |
| 0415 | 0815 | 1215 | 1615 | 2015 | 0015 | arr 20" dep | 0945 | 1345 | 1745 | 2145 | 0145 | 0545 |
| L1 | L2 | L3 | L4 | L5 | L6 | | L1 | L2 | L3 | L4 | L5 | L6 |
| 0515 | 0915 | 1315 | 1715 | 2115 | 0115 | dep 20" arr | 0845 | 1245 | 1645 | 2045 | 0045 | 0445 |
| L1 | L2 | L3 | L4 | L5 | L6 | | L1 | L2 | L3 | L4 | L5 | L6 |
| 0700 | 1100 | 1500 | 1900 | 2300 | 0300 | arr 17' dep | 0700 | 1100 | 1500 | 1900 | 2300 | 0300 |
| L7 | L8 | L9 | L10 | L11 | L12 | | L7 | L8 | L9 | L10 | L11 | L12 |
| 0800 | 1200 | 1600 | 2000 | 2400 | 0400 | dep 17' arr | 0600 | 1000 | 1400 | 1800 | 2200 | 0200 |
| L7 | L8 | L9 | L10 | L11 | L12 | | L7 | L8 | L9 | L10 | L11 | L12 |
| 0915 | 1315 | 1715 | 2115 | 0115 | 0515 | arr 16" dep | 0445 | 0845 | 1245 | 1645 | 2045 | 0045 |
| L7 | L8 | L9 | L10 | L11 | L12 | | L7 | L8 | L9 | L10 | L11 | L12 |
| 1015 | 1415 | 1815 | 2215 | 0215 | 0615 | dep 16" arr | 0345 | 0745 | 1145 | 1545 | 1945 | 2345 |
| L7 | L8 | L9 | L10 | L11 | L12 | | L7 | L8 | L9 | L10 | L11 | L12 |
| 1100 | 1500 | 1900 | 2300 | 0300 | 0700 | arr 15' dep | 0300 | 0700 | 1100 | 1500 | 1900 | 2300 |
| YD | YD | YD | YD | YD | YD | | YD | YD | YD | YD | YD | YD |
| 1130 | 1530 | 1930 | 2330 | 0330 | 0730 | end 15' beg | 0130 | 0530 | 0930 | 1330 | 1730 | 2130 |

FIGURE 20

| MI | MIII | MV | MVII | MIX | MXI | ---Relay--- | MII | MIV | MVI | MVIII | MX | MXII |
|---|---|---|---|---|---|---|---|---|---|---|---|---|
| | | Read Down | | | | Node | | | Read Up | | | |
| 0030 | 0430 | 0830 | 1230 | 1630 | 2030 | beg 18' end | 1830 | 2230 | 0230 | 0630 | 0830 | 1230 |
| YD | YD | YD | YD | YD | YD | | YD | YD | YD | YD | YD | YD |
| 0200 | 0600 | 1000 | 1400 | 1800 | 2200 | dep 18' arr | 1800 | 2200 | 0200 | 0600 | 1000 | 1400 |
| M1 | M2 | M3 | M4 | M5 | M6 | | M3 | M4 | M5 | M6 | M1 | M2 |
| 0245 | 0645 | 1045 | 1445 | 1845 | 2245 | arr 19" dep | 1715 | 2115 | 0115 | 0515 | 0915 | 1315 |
| M1 | M2 | M3 | M4 | M5 | M6 | | M3 | M4 | M5 | M6 | M1 | M2 |
| 0345 | 0745 | 1145 | 1545 | 1945 | 2345 | dep 19" arr | 1615 | 2015 | 0015 | 0415 | 0815 | 1215 |
| M1 | M2 | M3 | M4 | M5 | M6 | | M3 | M4 | M5 | M6 | M1 | M2 |
| 0500 | 0900 | 1300 | 1700 | 2100 | 0100 | arr 20' dep | 1500 | 1900 | 2300 | 0300 | 0700 | 1100 |
| M1 | M2 | M3 | M4 | M5 | M6 | | M3 | M4 | M5 | M6 | M1 | M2 |
| 0600 | 1000 | 1400 | 1800 | 2200 | 0200 | dep 20' arr | 1400 | 1800 | 2200 | 0200 | 0600 | 1000 |
| M7 | M8 | M9 | M10 | M11 | M12 | | M7 | M8 | M9 | M10 | M11 | M12 |
| 0900 | 1300 | 1700 | 2100 | 0100 | 0500 | arr 21' dep | 1100 | 1500 | 1900 | 2300 | 0300 | 0700 |
| M7 | M8 | M9 | M10 | M11 | M12 | | M7 | M8 | M9 | M10 | M11 | M12 |
| 1000 | 1400 | 1800 | 2200 | 0200 | 0600 | dep 21' arr | 1000 | 1400 | 1800 | 2200 | 0200 | 0600 |
| M13 | M14 | M15 | M16 | M17 | M18 | | M17 | M18 | M13 | M14 | M15 | M16 |
| 1400 | 1800 | 2200 | 0200 | 0600 | 1000 | arr 22"'dep | 0600 | 1000 | 1400 | 1800 | 2200 | 0200 |
| 1400 | 1800 | 2200 | 0200 | 0600 | 1000 | dep 22"'arr | 0600 | 1000 | 1400 | 1800 | 2200 | 0200 |
| M21 | M22 | M23 | M24 | M19 | M20 | | M19 | M20 | M21 | M22 | M23 | M24 |
| 1700 | 2100 | 0100 | 0500 | 0900 | 1300 | arr 23' dep | 0300 | 0700 | 1100 | 1500 | 1900 | 2300 |
| M21 | M22 | M23 | M24 | M19 | M20 | | M19 | M20 | M21 | M22 | M23 | M24 |
| 1730 | 2130 | 0130 | 0530 | 0930 | 1330 | end 23' beg | 0130 | 0530 | 0930 | 1330 | 1730 | 2130 |

FIGURE 21

| NI | NIII | NV | ---Relay--- | NII | NIV | NVI |
|---|---|---|---|---|---|---|
| | Read Down | | Node | | Read Up | |
| 0400 | 1200 | 2000 | beg 21' end | 0600 | 1400 | 2200 |
| YD | YD | YD | | YD | YD | YD |
| 0530 | 1330 | 2130 | dep 21' arr | 0530 | 1330 | 2130 |
| N1 | N2 | N3 | | N3 | N1 | N2 |
| 0645 | 1445 | 2245 | arr 24" dep | 0415 | 1215 | 2015 |
| N1 | N2 | N3 | | N3 | N1 | N2 |
| 0745 | 1545 | 2345 | dep 24" arr | 0315 | 1115 | 1915 |
| N1 | N2 | N3 | | N3 | N1 | N2 |
| 0930 | 1730 | 0130 | arr 25' dep | 0130 | 0930 | 1730 |
| N4 | N5 | N6 | | N5 | N6 | N4 |
| 1030 | 1830 | 0230 | dep 25' arr | 0030 | 0830 | 1630 |
| N4 | N5 | N6 | | N5 | N6 | N4 |
| 1130 | 1930 | 0330 | arr 27" dep | 2330 | 0730 | 1530 |
| N4 | N5 | N6 | | N5 | N6 | N4 |
| 1230 | 2030 | 0430 | dep 27" arr | 2230 | 0630 | 1430 |
| N4 | N5 | N6 | | N5 | N6 | N4 |
| 1330 | 2130 | 0530 | arr 30' dep | 2130 | 0530 | 1330 |
| N7 | N8 | N9 | | N7 | N8 | N9 |
| 1430 | 2230 | 0630 | dep 30' arr | 2030 | 0430 | 1230 |
| N7 | N8 | N9 | | N7 | N8 | N9 |
| 1630 | 0030 | 0830 | arr 32' dep | 1830 | 0230 | 1030 |
| N7 | N8 | N9 | | N7 | N8 | N9 |
| 1730 | 0130 | 0930 | dep 32' arr | 1730 | 0130 | 0930 |
| N10 | N11 | N12 | | N11 | N12 | N10 |
| 2030 | 0430 | 1230 | arr 39' dep | 1430 | 2230 | 0630 |
| N10 | N11 | N12 | | N11 | N12 | N10 |
| 2130 | 0530 | 1330 | dep 39' arr | 1330 | 2130 | 0530 |
| N10 | N11 | N12 | | N11 | N12 | N10 |
| 0030 | 0830 | 1630 | arr 45' dep | 1030 | 1830 | 0230 |
| N10 | N11 | N12 | | N11 | N12 | N10 |
| 0130 | 0930 | 1730 | dep 45' arr | 0930 | 1730 | 0130 |
| N13 | N14 | N15 | | N13 | N14 | N15 |
| 0330 | 1130 | 1930 | arr 47' dep | 0730 | 1530 | 2330 |
| N13 | N14 | N15 | | N13 | N14 | N15 |
| 0430 | 1230 | 2030 | dep 47' arr | 0630 | 1430 | 2230 |
| N13 | N14 | N15 | | N13 | N14 | N15 |
| 0530 | 1330 | 2130 | arr 51' dep | 0530 | 1330 | 2130 |
| YD | YD | YD | | YD | YD | YD |
| 0600 | 1400 | 2200 | end 51' beg | 0400 | 1200 | 2000 |

FIGURE 22

| PI | PIII | PV | ---Relay--- | PII | PIV | PVI |
|---|---|---|---|---|---|---|
| | Read Down | | Node | | Read Up | |
| 0130 | 0930 | 1730 | beg 27' end | 0930 | 1730 | 0130 |
| P1 | P2 | P3 | | P1 | P2 | P3 |
| 0300 | 1100 | 1900 | dep 27' arr | 0900 | 1700 | 0100 |
| P1 | P2 | P3 | | P1 | P2 | P3 |
| 0500 | 1300 | 2100 | arr 28' dep | 0700 | 1500 | 2300 |
| P1 | P2 | P3 | | P1 | P2 | P3 |
| 0600 | 1400 | 2200 | dep 28' arr | 0600 | 1400 | 2200 |
| P4 | P5 | P6 | | P6 | P4 | P5 |
| 0730 | 1530 | 2330 | arr 29' dep | 0430 | 1230 | 2050 |
| P4 | P5 | P6 | | P6 | P4 | P5 |
| 0830 | 1630 | 0030 | dep 29' arr | 0330 | 1130 | 1930 |
| P4 | P5 | P6 | | P6 | P4 | P5 |
| 1000 | 1800 | 0200 | arr 26' dep | 0200 | 1000 | 1800 |
| YD | YD | YD | | YD | YD | YD |
| 1030 | 1830 | 0230 | end 26' beg | 0030 | 0830 | 1630 |

FIGURE 23

| QI | QIII | QV | ---Relay--- | QII | QIV | QVI |
|---|---|---|---|---|---|---|
| | Read Down | | Node | | Read Up | |
| 0530 | 1330 | 2130 | beg 42' end | 1530 | 2330 | 0730 |
| YD | YD | YD | | YD | YD | YD |
| 0700 | 1500 | 2300 | dep 42' arr | 1500 | 2300 | 0700 |
| Q1 | Q2 | Q3 | | Q1 | Q2 | Q3 |
| 0730 | 1530 | 2330 | arr 37" dep | 1430 | 2230 | 0630 |
| Q1 | Q2 | Q3 | | Q1 | Q2 | Q3 |
| 0830 | 1630 | 0030 | dep 37" arr | 1330 | 2130 | 0530 |
| Q1 | Q2 | Q3 | | Q1 | Q2 | Q3 |
| 1000 | 1800 | 0200 | arr 38' dep | 1200 | 2000 | 0400 |
| Q1 | Q2 | Q3 | | Q1 | Q2 | Q3 |
| 1100 | 1900 | 0300 | dep 38' arr | 1100 | 1900 | 0300 |
| Q4 | Q5 | Q6 | | Q6 | Q4 | Q5 |
| 1400 | 2200 | 0600 | arr 39' dep | 0800 | 1600 | 2400 |
| Q4 | Q5 | Q6 | | Q6 | Q4 | Q5 |
| 1500 | 2300 | 0700 | dep 39' arr | 0700 | 1500 | 2300 |
| Q7 | Q8 | Q9 | | Q8 | Q9 | Q7 |
| 1800 | 0200 | 1000 | arr 40' dep | 0400 | 1200 | 2000 |
| Q7 | Q8 | Q9 | | Q8 | Q9 | Q7 |
| 1900 | 0300 | 1100 | dep 40' arr | 0300 | 1100 | 1900 |
| Q10 | Q11 | Q12 | | Q10 | Q11 | Q12 |
| 2200 | 0600 | 1400 | arr 41' dep | 2400 | 0800 | 1600 |
| Q10 | Q11 | Q12 | | Q10 | Q11 | Q12 |
| 2300 | 0700 | 1500 | dep 41' arr | 2300 | 0700 | 1500 |
| Q13 | Q14 | Q15 | | Q15 | Q13 | Q14 |
| 0200 | 1000 | 1800 | arr 51' dep | 2000 | 0400 | 1200 |
| Q13 | Q14 | Q15 | | Q15 | Q13 | Q14 |
| 0230 | 1030 | 1830 | end 51' beg | 1830 | 0230 | 1030 |

Figure 33

| Current Operating Procedure Ave. Hours | Activity | Four-hour Interchanging Relays Ave. Hours |
|---|---|---|
| 4 | Pulling from customer until arrival at 18 | 4 |
| 6 | Arrival at 18 until classification | 1 |
| 12 | Classification at 18 until departure | 2 |
| 2 | Movement from 18 to 20 | 3 |
| 6 | Arrival at 20 until classification | 1 |
| 12 | Classification at 20 until departure | 2 |
| 16* | Movement from 20 to 55 | 20** |
| 6 | Arrival at 55 until classification | 1 |
| 12 | Classification at 55 until departure | 12 |
| 4 | Departure from 55 until spotting at customer | 4 |
| 80 hrs. | Start-to-finish Totals | 50 hrs. |
| +24 hrs. | With one missed connection | +4 hrs. |
| +48 hrs. | With two missed connection | +8 hrs. |

* Includes 15 hrs. on the road + 1 hr. set-offs & pick-ups

** Includes 15 hrs. on the road + 5 1-hour interchanges

TRANSPORATION SYSTEM AND METHOD OF OPERATION

BACKGROUND OF THE INVENTION

Railroads are disadvantaged in being both labor intensive and capital intensive. Labor expenses have historically comprised about half of all railway operating expenses. Capital assets represent astronomical acquisition and replacement costs for railroads, which have asset turnover ratios (annual revenue divided by total assets) around 0.5 using book values which grossly underestimate replacement costs, versus asset turnover ratios for truck lines around 2.0. Furthermore, no amount of capital could replace railroad right of way through industrial areas today.

Railroads have responded to decreasing market share by attempting to decrease labor expenses and plant expenditures even faster. Over the last seventy years U.S. railroads' share of the merchandise intercity freight market has fallen from 90% to 10%, their employment has been cut by 1,700,000, or 83%, and 110,000 miles, or 42% of their right of way has been abandoned (which far exceeds the 42,000 total interstate highway miles in operation today). Minimization of labor costs and plant requirements have been generally accepted as appropriate strategic objectives for the industry, and technological innovation has been directed at cost reductions.

It is known to arrange freight trains into Blocks of cars, a Block being a set of cars destined for the same point. The conventional cost-cutting goal is to create trains with the largest, longest-distance Blocks possible; because longer, fewer, farther-destined trains should reduce the number of train service employees required and the number of line-of-road tracks and sidings required per ton-mile moved, given current work-rules and operating procedures. Therefore, as many Blocks are created at each classification yard as can accumulate a significant number of cars over a twenty-four hour period, such that only a few Blocks need be coupled together to reach maximum safe train length, and such that each train sets off Blocks and picks up Blocks en route as seldom as possible. For example, a modern hump yard will typically have 30 to 60 classification tracks, each track collecting cars to be emptied out five to seven times per week for inclusion in 100-to-150 car trains of three-to-five Blocks each.

The nominally optimal solution to running trains and blocking cars in order to minimize the number of trains operated for a given amount of traffic (and thereby minimize the number of crews and engines used) is given by the integer programming model in FIG. 1. The two major assumptions justifying this model are reasonable: that variable costs are a stepwise function of the number of crews used, with other operating costs for a given amount of traffic being fixed, and that the arrival rates of cars into the system are predictable. However, this model is not commercially viable for two primary reasons: even with the selective elimination of improbable variables, the matrix inversion required to solve this model is too large for available computers, except for trivial problems (see FIG. 2); and the integer programming solution does not take into account any transit time requirements.

In practice the railroads develop train schedules and blocking patterns through trial and error, striving for maximum-length minimum-number-of-Block trains subject to minimum service constraints. This results in highly fragmented, complicated, and inconsistent service. "Unit trains" are run in the specialized instances where a large volume of traffic all from one origin or gathering point to one destination or distribution point is available at one time (such as mineral, grain, or double-stack container unit trains). Otherwise, trains are run with combinations of Blocks. The common practice is to divide the non-unit trains further into separate intermodal, "manifest" (general merchandise), and customized-service systems—the intermodal trains operating between piggyback terminals, the manifest trains operating between classification yards, and the customized-service trains operating between industrial serving yards or specialized terminals. Each system sorts cars as they enter that system into Blocks of cars, with each Block dispatched to its respective destination once per day or so—sometimes in "advertised" trains, sometimes in "extras," which are dispatched as needed.

The manifest car is particularly erratic in movement as it "leapfrogs" from classification yard to classification yard in unreliable "hops" as service fluctuates during the week. The upshot is that each time a freight car stops moving, it generally has one chance each twenty-four hours to get moving again. The average distance traveled per day by a U.S. railroad freight car in 1984 was 54 miles.

A serious ancillary problem of the present scheduling and blocking practices is the inefficient and insensitive use of labor. Conventional freight train timetables, even if they were strictly followed (which they usually are not), cannot coordinate the efficient use of resources. Only a small fraction of line-haul crews work a standard eight hours ± thirty minutes. Most either work much less but get paid for eight hours anyway or work much more (up to the federally-mandated twelve-hour maximum), for which they are paid "time and a half" with little real time before reporting back to duty. There is widespread use of "extra boards," groups of train service employees with no regular assignments but who are on two-hour call beginning eight or ten hours after their last assignments, who run extra trains and fill in on all-too-irregular advertised trains. Even advertised line-haul crews usually spend half of their sleeping time away from home.

Operations usually vary day-to-day with volume and resource changes, and even subtle daily differences in trains cause conflicting movements and compounding delays. There is the confusion bred of irregularity. There is the inexorable elimination of individuals with a sense of urgency or with outside interests requiring specific off-duty time (like athletic, social, or religious activities). There is a high incidence of sleep disorders, substance abuse, and family problems. In a society which places emphasis on personal time and recreation, the railroads must pay dearly for labor under current practices. Their transportation workers are disaffected, yet fiercely fraternal and intransigent about archaic jobs and working rules. In 1984, the average railroad engineer had a high school education, was on duty fifty-one hours per non-vacation week, and earned $46,650. Their supervisors were asked to work much longer for much less.

ADVANTAGES OF THE PRESENT INVENTION

The present invention describes a novel and improved operating procedure which creates a premium service network with frequency of service between yards increased by a factor of six, with drastically reduced total transit time of cars, and with real reliability of service and simplicity of transit time calculation so as to make transit time guarantees feasible. The present invention has the distinct advantages of being compatible with existing railroad technologies, of requiring only small capital expenditures when compared to the cost of existing plant structures, of requiring comparatively little additional labor, and, most importantly, of normalizing the workday for most transportation service personnel.

Thus, the present invention addresses fundamental problems: trucks' overwhelming service advantage, the wasting of economies of scale and the complication of service patterns under the present fragmented traffic systems, and the hardships of current line-haul railroad employment; but it does not hold itself out to minimize anything at all, certainly not costs or investment—the traditional objectives.

Implicit is the assumption that cost minimization should only be a narrow tactical objective, one which is held in check by the global strategic objective of providing desirable service—that desirable service always precedes the winning of traffic. In a service industry, the reduction of service in response to losses to competitors guarantees the self-fulfilling prophecy of successive iterations of contraction. The present invention is a very efficient and humane way to improve railroad service significantly.

SUMMARY OF THE INVENTION

This invention relates in general to transportation and in particular to an operating procedure for the transportation of specialized Units which move within a network of linear transportation segments or Lines and which can be connected to one another. The express goal of this invention is to establish orderly, reliable, and expedited movements of Units from their various given origin Nodes to their various given destination Nodes in such a way that labor and capital assets are utilized in a very predictable and efficient manner. The instant application as described later in the disclosed embodiment is for freight railroad transportation.

Accordingly, it is an object of the present invention to provide a novel and improved transportation operating procedure which creates a premium service network.

It is another object of the present invention to provide a transportation operating procedure utilizing a novel system of connecting and disconnecting Units being transported at transportation Nodes.

It is another object of the present invention to provide a transportation operating procedure which establishes easily-calculated and understood schedules for the transportation of all Units from their respective origin Nodes to their respective destination Nodes.

It is another object of the present invention to provide a transportation operating procedure which can lessen delays and expedite movements across a transportation network.

Still another object of the present invention is to provide an operating procedure which better utilizes the factors of production in providing transportation service.

Yet another object of the present invention is to provide a transportation operating procedure which normalizes the employment of human resources in providing transportation service.

Other objects and many of the attendant advantages of the present invention will become more apparent from consideration of the following disclosed embodiment thereof, including the attached drawings, in which:

BRIEF DESCRIPTION OF THE DRAWINGS

FIG. 1 shows an integer programming model formulation minimize variable transportation operating cost;

FIG. 2 is a table showing the proliferation of variables of the integer programming model, where u equals the number of routes for n−1 yards;

FIG. 6 shows train schedules on a Line with eight-hour Cue Frequency the first leg of crew's workday being underlined;

FIG. 9 is a daily schedule for Route A of the network shown in FIG. 8 having a Cue Frequency of 4 hours, each crew number is alphanumeric with the crew's first job underlined;

FIG. 10 is a daily schedule for Route B of the network shown in FIG. 8 having a Cue Frequency of 4 hours, each crew number is alphanumeric with the crew's first job underlined;

FIG. 11 is a daily schedule for Route C of the network shown in FIG. 8 having a Cue Frequency of 4 hours, each crew number is alphanumeric with the crew's first job underlined;

FIG. 12 is a daily schedule for Route D of the network shown in FIG. 8 having a Cue Frequency of 4 hours, each crew number is alphanumeric with the crew's first job underlined;

FIG. 13 is a daily schedule for Route E of the network shown in FIG. 8 having a Cue Frequency of 4 hours, each crew number is alphanumeric with the crew's first job underlined;

FIG. 14 is a daily schedule for Route F of the network shown in FIG. 8 having a Cue Frequency of 4 hours, each crew number is alphanumeric with the crew's first jobs underlined;

FIG. 15 is a daily schedule for Route G of the network shown in FIG. 8 having a Cue Frequency of 4 hours, each crew number is alphanumeric with the crew's first job underlined;

FIG. 16 is a daily schedule for Route H of the network shown in FIG. 8 having a Cue Frequency of 8 hours, each crew number is alphanumeric with the crew's first job underlined;

FIG. 17 is a daily schedule for Route J of the network shown in FIG. 8 having a Cue Frequency of 4 hours, each crew number is alphanumeric with the crew's first job underlined;

FIG. 18 is a daily schedule for Route K of the network shown in FIG. 8 having a Cue Frequency of 8 hours, each crew number in alphanumeric with the crew's first job underlined;

FIG. 19 is a daily schedule for Route L of the network shown in FIG. 8 having a Cue Frequency of 4 hours, each crew number is alphanumeric with the crew's first job underlined;

FIG. 20 is a daily schedule for Route M of the network shown in FIG. 8 having a Cue Frequency of 4 hours, each crew number is alphanumeric with the crew's first job underlined;

FIG. 21 is a daily schedule for Route N of the network shown in FIG. 8 having a Cue Frequency of 8 hours, each crew number is alphanumeric with the crew's first job underlined;

FIG. 22 is a daily schedule for Route P of the network shown in FIG. 8 having a Cue Frequency of 8 hours, each crew number is alphanumeric with the crew's first job underlined;

FIG. 23 is a daily schedule for Route Q of the network shown in FIG. 8 having a Cue Frequency of 8 hours, each crew number is alphanumeric with the crew's first job underlined;

| | | | | | | |
|---|---|---|---|---|---|---|
| a for | 0100–0159, | | 0900–0959, | | 1700–1759, | |
| | | 0500–0559, | | 1300–1359, | | 2100–2159; |
| a' for | 0100–0159, | | 0900–0959, | | 1700–1759, | |
| a" for | | 0500–0559, | | 1300–1359, | | 2100–2159; |
| b for | 0200–0259, | | 1000–1059, | | 1800–1859, | |
| | | 0600–0659, | | 1400–1459, | | 2200–2259; |
| b' for | 0200–0259, | | 1000–1059, | | 1800–1859, | |
| b" for | | 0600–0659, | | 1400–1459, | | 2200–2259; |
| c for | 0300–0359, | | 1100–1159, | | 1900–1959, | |
| | | 0700–0759, | | 1500–1559, | | 2300–2359; |
| c' for | 0300–0359, | | 1100–1159, | | 1900–1959, | |
| c" for | | 0700–0759, | | 1500–1559, | | 2300–0059; |
| d for | 0400–0459, | | 1200–1259, | | 2000–2059, | |
| | | 0800–0859, | | 1600–1659, | | 2400–0059; |
| d' for | 0400–0459, | | 1200–1259, | | 2000–2059, | |
| d"for | | 0800–0859, | | 1600–1659, | | 2400–0059; |

Figure 25:
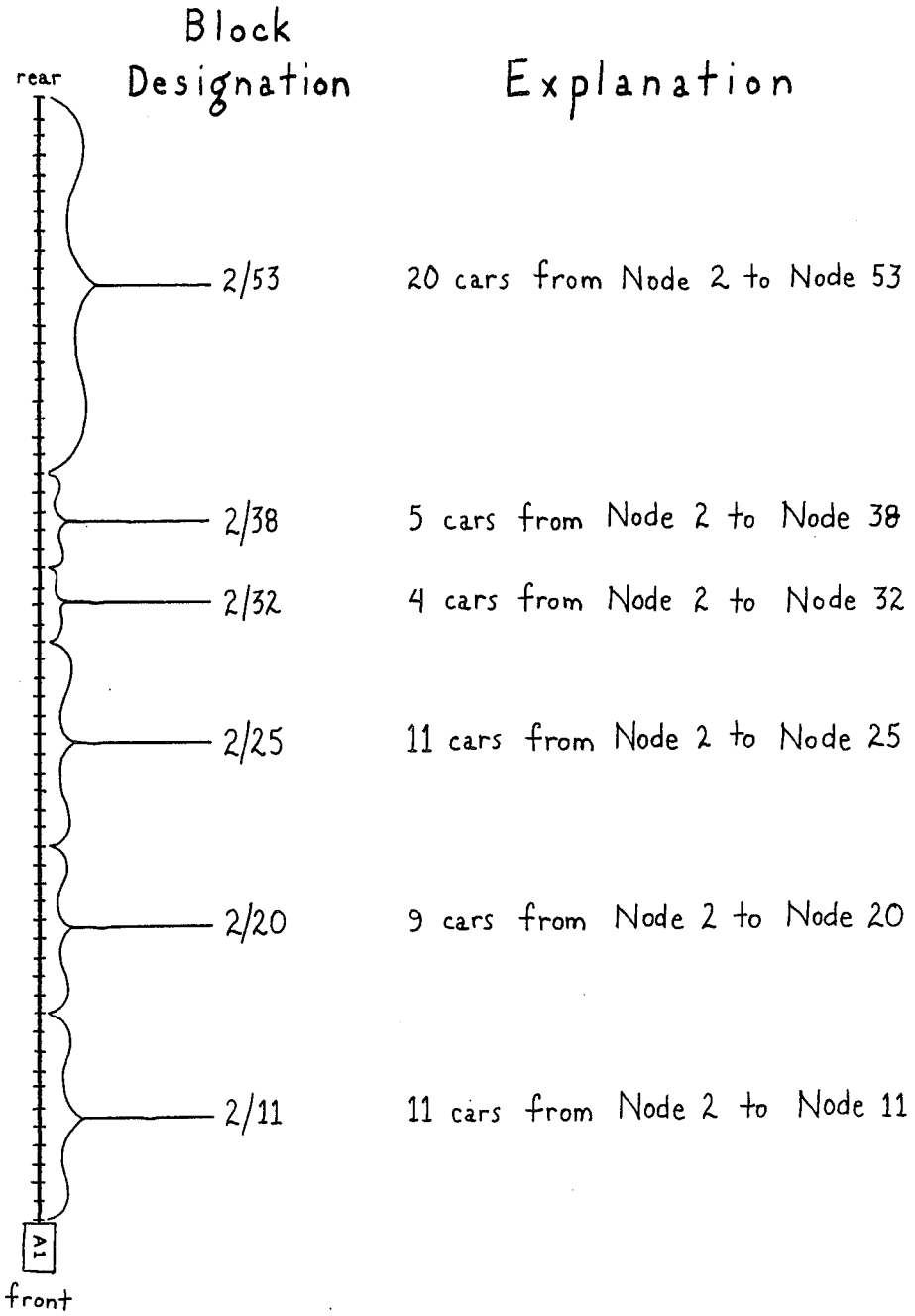
Figure 26:
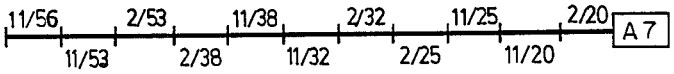

FIG. 25 shows an assembled Relay, Route A Relay Section AI, ready for departure south from Node 2;

FIGS. 26-to-32 show an interchange process at Node 20 where the designations over each Block indicate the origin Node/destination Node and designations inside locomotives (boxes) indicate crew numbers; and FIG. 33 shows an illustration of premium service network transit time compared to conventional operating procedure transit time from near node 18 to near node 55.

DETAILED DESCRIPTION OF A PREFERRED EMBODIMENT

A. General Inventive Method System

It should be noted that the present invention is a heuristic model, which determines a feasible solution to moving Units from their origins to their destinations according to subjective requirements, not some optimization algorithm. Notwithstanding this fact, the stochastic process to be defined does more than just find any feasible solution, but also demands and creates information so that successive solutions rachet service up and costs down. In economic language, one could say that the present invention "satisfices" a transportation problem, with the collateral benefits of a measurement and control framework for subsequent dynamic Pareto optimization.

Stated in general terms, the present invention creates a premium service network which utilizes a transportation system comprised of one or more linear continuums or Lines, where there is a method of transporting Units along the Lines; where said Units can be linearly connected to one another at two ends each; where there is an advantage to the temporary combination of Units during transportation such as the sharing of locomotive energy or movement control; where there are distinct Nodes along the Lines for the operation of connecting or disconnecting Units; and where there is an advantage to the return of at least one moving resource to its starting point (i.e. home base) at the end of its period of employment.

One embodiment of such a transportation system would be a railroad, where: (1) right of way with track structures represents Lines; (2) freight trains comprise a method of transport along Lines; (3) rolling stock represents the Units which it is desirable to connect linearly for movement; (4) operating crews are moving resources which return to their starting points; and (5) yards represent Nodes where units can be connected or disconnected for movement.

The Lines and method of transport may be any linear device for transporting physical objects, the Units to be transported may be any entity which can be connected at two ends to like entities for movement, the moving resource returning to its starting point may be any factor of production with a home base, and the Nodes may be representative of any geographic locations, however small or large, from which and to which transportation movements can be said to occur.

The invention defines a new concept of Relays as the uniquely ordered movement of connected Units along the Lines. For example, in a freight train transportation system, Relays would be freight trains having selectively ordered and grouped rolling stock.

The initial step in the creation of the premium service network is determining the frequency of service, or Cue Frequency, or even cadence of Unit movement. Cue Frequency is defined as the scheduled time separation between all Relays in the same direction on a Route. Cue Frequency is a subjective decision based upon some absolute requirement, the competitive environment, the availability of resources, and/or the optimal amount of time to use a resource. The Cue Frequency cannot be irregular. It must continue at the same even cycle of service starts over periods of operation.

All Lines possible are chosen to participate in the premium service network, only excluding those Lines on which the Units becoming available for movement over each minimum Cue Frequency are forecasted to fall below some subjective minimum number. The criteria for selecting this minimum number may include the average revenue per Unit-distance versus the average incremental cost per Relay-distance, the frequency distribution of unit generation/consumption over time versus the Cue Frequency, and the potential for increases in Unit generation/consumption as a function of service. The criteria may differ among Lines, thereby changing the minimum Unit number among Lines. There may be supplementary criteria, such as minimum volumes over several Cue Frequencies so that the average revenue per Unit-volume-distance exceeds the average variable cost per Relay-distance.

The next step in creating the premium service network is to designate Nodes along the chosen Lines. Nodes are conveniently spaced and designed for gathering, dispersing, generating, consuming, assembling, disassembling or otherwise manipulating the Units to be transported. The location of Nodes is another subjective determination, whose selective criteria may include the existing plant facilities, the points of juncture among Relay Routes, the ease of gathering traffic at and dispersing traffic from a location, the cost of adding necessary plant facilities at a location, the running times from the Nodes on either side—periods of time which can now exceed one-half the period of employment for any factor of production which it is required to return to its starting point after its period of employment, the cost of improving running times between prospective Nodes to comply with the previous criteria, and, as practicable, limiting the number of Nodes traversed by Units to the number of Blocks accommodated on each Relay.

Note that the present invention addresses only the movement of Units between Nodes, not how the Units are gathered at or generated at the Nodes or how they are dispersed from or consumed at the Nodes. Therefore, each Unit in service has one origin Node and one destination Node, determined exogenously.

Nodes are grouped into a set or sets to create a Route or Routes over which Relays are run. So a Route is a linear series of Nodes, which are themselves designated with Routes in mind, over which successive Relays are run. Routes are designated subjectively, based upon existing traffic flows, potential traffic flows, a configuration which includes all Nodes designated for the premium service network, and capacities of Lines and Nodes. Consideration must also be given to the fact that preferably the number of Nodes between major Nodal pairs is not greater than the number of Blocks in a Relay minus one.

Primary Nodes are defined as those at which both home based factors of production (i.e. crews) and Units are interchanged; Secondary Nodes as those where no home based factors of production interchange but some Units are interchanged; Tertiary Nodes as those where home based factors of production are interchanged but not Units. The unique interchanging process at Nodes is defined below. Note that Route-end Nodes are considered Primary Nodes since both factors of production and Units originate or terminate at Route-end nodes with respect to their relationship to the premium service system.

The inclusion of Nodes in a particular Route is an inter-dependent balance of competing priorities, which rank differently in different possible applications. In any case, Relays in one direction on a Route will be separated by exactly one Cue Frequency and all Relays on a Route will be scheduled to meet opposing Relays at Primary and Tertiary Nodes concurrently so that certain factors of production (such as operating crews) can be exchanged between Relays, thereby returning those factors to their starting Nodes at the termination of their periods of employment. Therefore, a Route's Nodes are always spaced with their Nodal interchanging points in mind.

The desired level of premium service activity for a Line is a function of the arrival rates of Units into a Line at its Nodes, the maximum safe Relay sizes between successive Nodes, the frequency distribution of arrival rates at Nodes, and the acceptable risk of arrival rates exceeding Relays' capacities. The actual level of premium service activity over a Line depends on three decision variables: the number of Routes operating on the Line, the Cue Frequencies of those Routes, and the Cue Sequencing (defined below) of those Routes. Various permutations of these three variables allow a large number of service activity levels on a Line from which to select.

Cue Sequencing refers to the spacing of Nodes from which home based factors of production originate. The fact that at least one moving factor of production returns to its starting point at the end of its period of employment means that opposing Relays on a Route will coordinate their meeting times at Primary and Tertiary Nodes so that a factor exchange can be effected without undue delay to the through movement of Units. A factor of production with a home base can travel no longer than one-half of its period of employment before it must reverse direction if speeds in each direction are equal, and no farther than some other derivable fraction of its period of employment if speeds in each direction differ.

Figure 3:
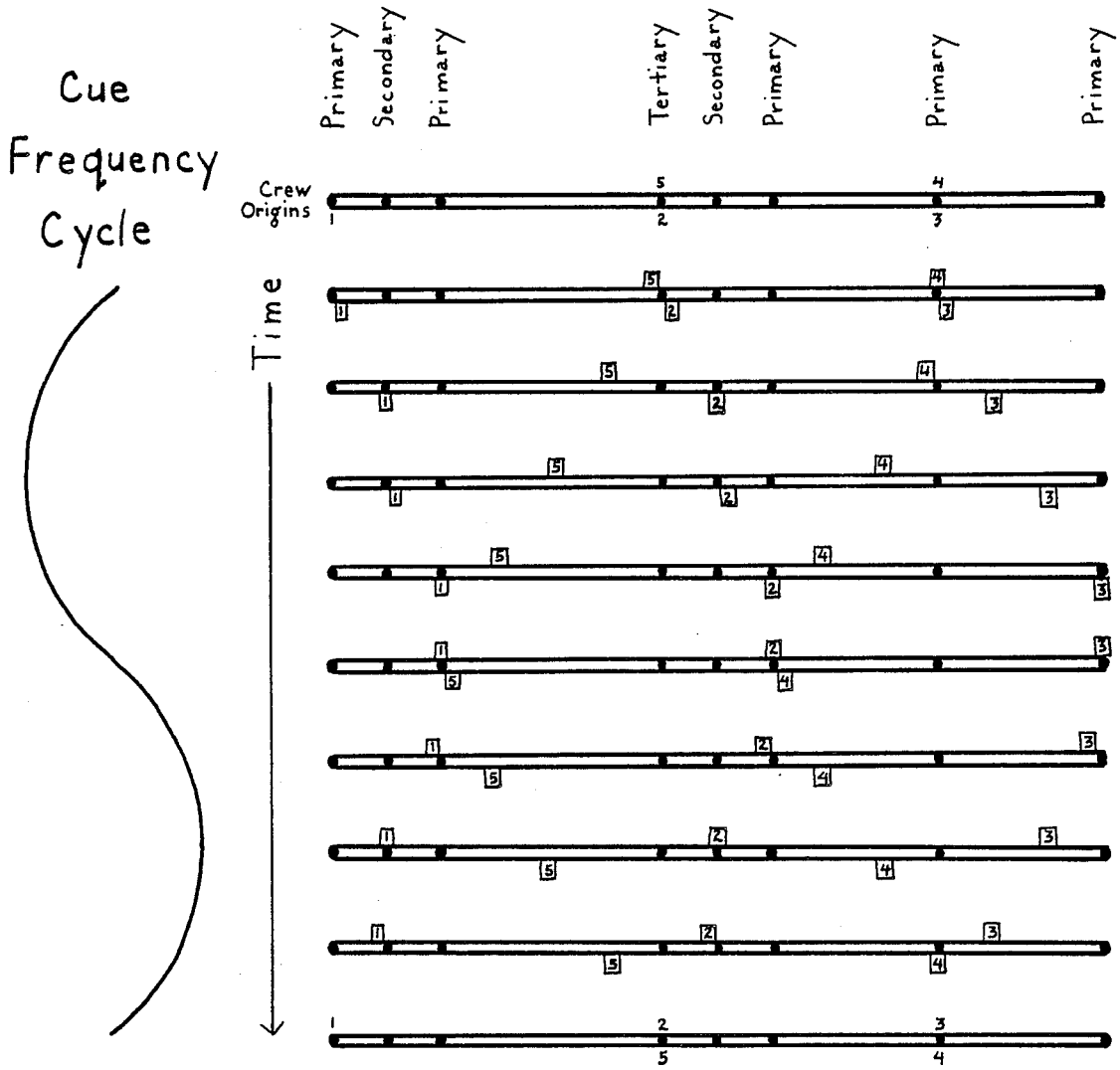
FIG. 3 shows the "alternating" method of Cue Sequencing, or spacing of starting Nodes for moving factors of production.

There are only two methods of Cue Sequencing, or spacing of home based factor origin Nodes. By definition, Relays depart all Primary and Tertiary Nodes once per Cue Frequency in each direction on a Route, and factors of production interchange at Primary and Tertiary Nodes only. If factors originate at every other Primary and Tertiary Node (in both directions except for Route-end Nodes), then each Relay will meet its first opposing Relay at its next Primary or Tertiary Node for factor interchange. FIG. 3 illustrates this "alternating" method of Cue Sequencing. Note that the number of Relays operating on a Route with alternating Cue Sequencing will be one less than the sum of Primary and Tertiary Nodes $(-1+P+T)$.

Figure 4:
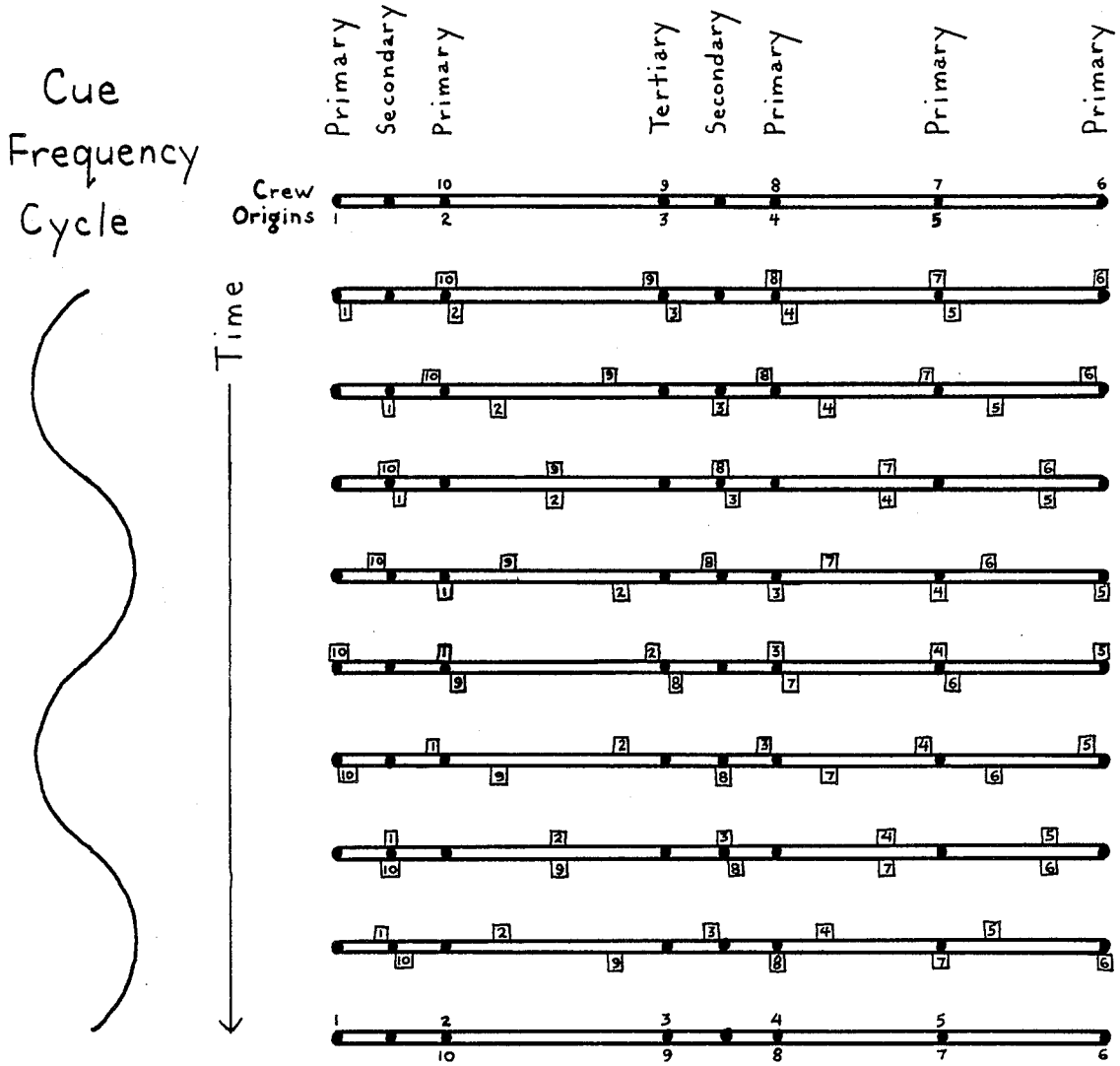
FIG. 4 shows the "consecutive" method of Cue Sequencing.
Figure 5:
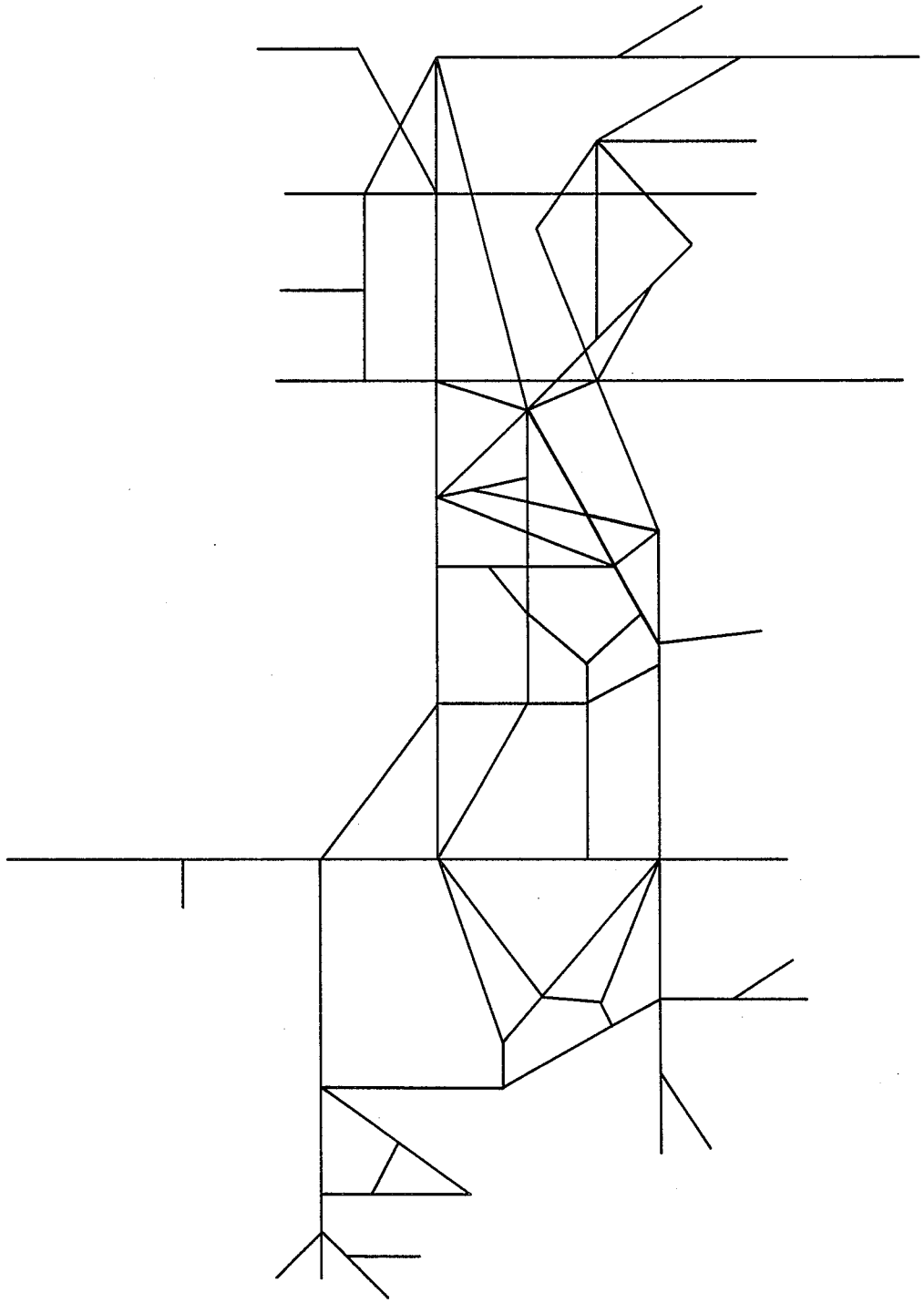
FIG. 5 shows a hypothetical railroad network.

If factors originate at every Primary and Tertiary Node on a Route (in both directions except for Route-end Nodes) then each Relay will pass its first opposing Relay between Nodes, and meet its second opposing Relay at its next Primary or Tertiary Node for factor interchange. FIG. 4 illustrates this "consecutive" method of Cue Sequencing. Note that the number of Relays operating on a Route with consecutive Cue Sequencing will be exactly double that of alternating Cue Sequencing, or two times one less than the sum of Primary and Tertiary Nodes on a Route $(2(-1+P+T))$.

The minimum premium service over a Line would be a single Route with Relays operating at the minimum Cue Frequency (as initially determined) with alternating Cue Sequencing. The maximum premium service over the short term would be the maximum number of Routes whose Relays could be physically accommodated by the extant transportation system. Over the long term capital improvements could increase the capacity of the transportation system and the service possible without limit.

The next step in the creation of the premium service network is determining the size and number of Blocks of Units which are to be included in each Relay. As noted above, a Block is a group of Units having a common destination. The size and number of Blocks per Relay is set subjectively, and may differ among Routes or even among different legs of the same Route.

Units may be selectively grouped within Blocks as Sub-blocks according to objective criteria. A Block may comprise two Sub-blocks: one Sub-block comprised of Units for that Nodal destination, the other Sub-block comprising units for transshipment.

The number of Blocks is based first on the amount of time allocated for the interchanging process at Nodes since the time required for the interchange increases at least geometrically with the number of Blocks in a Relay. The number of Relay Blocks is also constrained by the forecasted number of Units in each Block versus the maximum safe number of Units in the Relay, the number of Sub-blocks defined, and by the number of Primary and Secondary Nodes remaining in the Route.

When the number of Blocks in a Relay leg is set, that number of immediately succeeding Primary and Secondary Nodes will be represented by Blocks in the Relay. By definition, no Nodes in a Route may be skipped. If there are more Primary and Secondary nodes remaining in the Route, the farthest nodes will not be represented directly by Blocks until the Relay reaches a Node where the number of Blocks equals the number of remaining Primary and Secondary Nodes.

At each Primary and Secondary Node, Units are assembled once during each Cue Frequency cycle into Blocks of Units destined for the Primary and Secondary Nodes just determined. If no single Route serves both the origin and destination Nodes of a Unit or if a Unit is destined to a Node on the same Route separated from its origin Node by more Nodes than the number of Blocks per Relay then that Unit would be included in a Block destined for a transshipment Node intermediate to the ultimate destination Node.

The size of a Block may not exceed a predetermined weight, length, and/or number limit, which is a subjective determination considering the operating capacity of Line segments in the Block's Route to its destination Node, and considering forecasted sizes of other Blocks which will be moved in the same Relay. Excess Units are held back for a succeeding Relay.

At each Primary Node at which home based factors originate (as specified by Cue Sequencing discussed above), the previously assembled Blocks are themselves assembled into Relays at the beginning of Relay service. For Consecutive Sequencing, one Relay at each of the two Route-end Nodes, and two Relays—one to go in each direction—at each intermediate factor originating Primary Node are formed. No other Relays are created. The Blocks are connected in either ascending or descending order, according to the succession of Nodes toward the end of the Relay's Route. After operations have begun, new Relays are assembled only at Route-end Nodes, one in each Cue cycle.

All Units traveling between Nodes move in Relays with the following possible exceptions:

(a) Units which, at intervals far exceeding Cue Frequency, arrive in high concentrations at a non-Nodal point and which are all destined to or move through a single distant point;

(b) Units which, at intervals far exceeding Cue Frequency, arrive at a Node in concentrations exceeding Block limits to their respective destination Nodes for numerous successive Relay sections; and (c) Units which are not handled in Relays due to emergencies or malfunctions in the transportation system.

In general, Relay operations are designed to accommodate random but statistically predictable and steady-state movements of Units, not large irregularly-timed movements. Those are handled in non-Relay conventional means when they cannot be accommodated on Relay service.

Each Relay traverses the Line segment to its next Node according to a schedule. A master schedule of operations between Nodes is created using the following general rule: Relays are scheduled to arrive at their next respective Primary or Tertiary Nodes such that they can interchange the required factors of production with their complementary opposing Relays and continue on without delay, making synchronized bi-directional "heartbeats" of Relay movements along each Route. The Cue times of different Routes may be offset in order to coordinate utilization of resources at Nodes where Routes intersect.

Schedules adhere to the following specific rules. Successive Relays in one direction on a Route depart each Node at separations of exactly one Cue Frequency. Relays lay over at each Primary and Secondary Node for the amount of time required for the Unit interchanging process discussed below. Each Relay meets a Relay moving in the opposite direction on the same Route at intermediate Primary and Tertiary Nodes, such that certain factors of production are changed or exchanged without delay to the Relay. Relays in the same direction cannot be scheduled to occupy the same stretch of Line at the same time, unless there is a double Line at the segment in question. Relays in opposite directions must be scheduled to meet at double Line segments or Nodes where they can pass without undue reduction in speed.

It is preferable to construct Relay schedules such that the interchanging processes of different Relays at a single Node are staggered, such that service between Nodes by different Routes is not bunched, and such that different Routes arrive at and depart from common Nodes at times conducive to smooth Unit connections between Routes. It greatly simplifies scheduling if Primary Nodes are separated by running times equal to half the Cue Frequency minus interchange time. By completing schedules for each Route in succession beginning with the longest or most complicated Route, the premium service network takes shape.

As noted above, Units of each Relay are interchanged at Primary and Secondary Nodes. The amount of time needed to interchange Units directly effects the spacing and number of Nodes.

Maintaining the Units in Blocks of commonly destined Units permits efficient Unit interchange and facilitates the efficiency of the system. Upon arrival at a Primary or Secondary Node in its Route, a Relay interchanges Blocks of Units by either:

(a) disconnecting the Block destined to that Node from the beginning or ending of the Relay, and disconnecting the remaining Relay between every second Block or Sub-block such that new Blocks can be inserted between existing Blocks so as to maintain the contiguous integrity of Units destined for the same Node or sub-group within a Node, or (b) connecting all Blocks accumulated at the Node to the beginning or ending of the Relay, with the order of the newly-connected Blocks being the opposite of those connected at the previous Node, such that Blocks destined to the same Node are connected, and disconnecting the pre-existing Relay at intervals such that the interspersed Blocks destined for that Node are removed.

Each Relay continues to traverse Line segments interchanging as described above at each successive Primary and Secondary Node in its Route according to its schedule. Information concerning the composition of the Blocks in oncoming Relays is transmitted ahead. The Blocks created at Primary and Secondary Nodes for inclusion in a Relay must not make the Relay exceed maximum Relay length for the subsequent legs. Upon arrival at its Route-end node, each Relay will be composed solely of a Block whose destination or transshipment destination is that Node. The Relay therefore terminates, and its operating resources are released for other use. When it is desired to interrupt or stop entirely the operation of the premium service network, it is advisable to stop all Relays on each Route during the same Cue cycle, in order to avoid the compression which would be caused by scrolling Relays into a limited number of Nodes.

Because this operating procedure imposes reliable schedules on the movements of Units between Nodes in all cases, and because interchanging and classification time requirements at Nodes can be accurately and uniformly predicted for connections between Routes, the elapsed time between entry of a Unit at its origin Node to arrival at its destination Node can be calculated using only the master schedule. Therefore, exact information is readily available to monitor deviations from schedules, to monitor capacity shortfalls or excesses in the system, or to conduct sensitivity analyses on changes in schedules, Relays, Routes, and/or Nodes. Service, as well as cost, is now quantified.

Relays arrive at, interchange at, and depart from Nodes so that:

(a) the forecasted accretion of units at Nodes both from internal and transshipment sources along a Route does not exceed the capacity of Relays scheduled in either direction to move them without delay or within an acceptable expected value of delay, and (b) Relays on different Routes are scheduled to arrive at and depart from common Nodes such that the operating resources required at the Node are both conserved and kept productive, as practicable.

Adjustments are made as conditions warrant. The interdependent costs and benefits of these adjustments are no longer a matter of intuition and guesswork as in current operating practices. They can be summed system wide, and quantitatively defended in order to drive the system towards higher service and/or lower costs.

B. Improved Freight Train Transportation System

Stated more particularly with respect to the Figures, there is shown an embodiment of the present invention for freight railroad transportation given a railroad network 5. The initial step in the creation of the premium service network is determining the maximum frequency of service—or maximum Cue Frequency of Relays—which is eight hours in this embodiment since it is desired that Relay crew members be scheduled for an eight-hour workday which terminates where it began. That means crews separated by eight hours of travel and intermediate work time can depart their respective starting points simultaneously, meet at a point in between, exchange Relays, and return to their starting points within the eight-hour maximum, without delaying the through movement of their opposing Relays. Alternating Cue Sequencing with a Cue Frequency exceeding eight hours would result in either meeting points for crew exchanges farther than four hours work time from the starting points, which would preclude returning to the starting points within eight hours; or delays in the movement of Relays.

FIG. 6 demonstrates a schedule for Relays on a Line with an eight-hour Cue Frequency. For example, Crew 1 commences its shift at Point A at 4:01 a.m., travels to Point B, then leaves Point B at 8:01 a.m. arriving back at Point A at 12 Noon (the end of an eight hour shift). Crew 4 has the same shift, but travels from Point C to Point B and back. In practice, more than one minute would likely be required between arrivals and departures, the amount of time being a function of the time needed to interchange crews and/or freight cars.

Next, some measurement of the frequency distribution of existing traffic moving over each portion of the Lines is gathered. Those Lines whose traffic, both loaded and empty carloads, falls above some logical but arbitrary threshold in each direction are considered for inclusion in the premium service network. A logical threshold for this embodiment, which has a minimum of three Relay starts in each direction each day at eight-hour intervals, would be 700 carloads in each direction per week, with a minimum of ten carloads arriving at a given Line for movement over each eight-hour Cue cycle. Forecasted increases in traffic resulting from the new premium service would also be considered in thresholds. The 700 per week and ten per eight-hour thresholds are logical since the average revenue per mile of 700 cars should exceed the long-term variable costs per mile of twenty-one (3/day×7 days) two-man non-delayed Relays; and since the average revenue per mile of ten cars should exceed the short-term incremental costs per mile of one two-man non-delayed Relay.

The next step in creating the premium service network is to finalize the Line segments to be included by designating Nodes where Relays originate, terminate, and interchange cars. The location of Nodes is a function of existing yards; proximity to points of juncture between Lines; ease of local service to actual origins and destinations of carloads; the cost of real estate and capital improvements at various locations; the running times from Nodes on either side, which cannot exceed ½ of maximum Cue Frequency (or four hours in this embodiment); the cost of improving running times to the Nodes on either side; and an attempt to limit the number of Nodes between major origin-destination Nodal pairs to five, which is the standard number of Blocks per Relay minus one, as described later. In general, Nodes are designated at existing yards approximately one, three, or four hours running time from the Nodes on either side.

Primary Nodes are defined as those at which crews and some cars are interchanged; secondary Nodes as those where crews stay with their Relays but some cars are interchanged; Tertiary Nodes as those where crews are interchanged but not cars.

Routes for successive Relays are designated based on existing and potential traffic flows, inclusion of all desired Lines, the capacities of Lines, and limiting to five the number of Nodes between major origin-destination Nodal pairs.

The level of premium service activity over a Line depends on three decision variables: the number of Routes operating on the Line, the Cue Frequencies of those Routes, and the Cue Sequencing of those Routes. Cue Frequency and Cue Sequencing are not independent in this embodiment. That is because it is desired to have crews reverse direction by interchanging Relays only once (as opposed to some other odd number of crew interchanges which would return crews to their home bases at the end of their workdays).

Since a crew's workday is pegged at eight hours, Cue Frequency is eight hours with alternating Cue Sequencing or Cue Frequency is four hours with consecutive Cue Frequency. If Cue Frequency on a Route is eight hours, the Cue Sequencing must be alternating, which means that only every other Primary or Tertiary Node on a Route is home base for crews. This is because if crews had started at the Primary/Tertiary Nodes on either side of a particular home base Node, then within four hours they would have to interchange at that particular Node in order for those crews to return home within eight hours. Then, by definition, Relays would have a four-hour Cue Frequency on that Route since they would depart each Node each four hours.

The only other Cue Frequency Cue Sequencing combination with this embodiment is four-hour Cue Frequency with consecutive Cue Sequencing. With a Cue Frequency of less than four hours with only one crew interchange, the crew would finish its workday in less than eight hours, resulting in a crew which is paid for eight hours but utilized less. With a Cue Frequency of more than four hours and consecutive Cue Sequencing, crews could not interchange and return to their home bases within the eight-hour workday.

If crews were allowed to reverse direction more than once, then Cue Frequency and Cue Sequencing would not necessarily be dependent variables. For example, suppose a series of Tertiary Nodes were separated by four hours running time each; A four-hour Cue Frequency could be achieved with consecutive Cue Sequencing by having each crew pass its first opposing Relay between nodes and then interchange Relays and change directions at the next Node with its second opposing Relay. The round trip would require eight hours. Alternatively, a four-hour Cue Frequency could be achieved with alternating Cue Sequencing by creating new Tertiary nodes halfway between all existing Nodes. Crews would reach the new Nodes in two hours, interchange Relays with their next opposing Relays, return to their origin Nodes in four hours total elapsed time, and repeat the process once. The two round trips would require exactly eight hours. Three interchanges would occur per crew and no crews would be based at the newly-created Nodes, thereby resulting in alternating Cue Sequencing. However, if Nodes were fixed, Cue Frequency and Cue Sequencing would always be dependent variables.

The minimum premium service over a Line would be a single Route with an eight-hour Cue Frequency with alternating Cue Sequencing. The addition of Routes and the use of four-hour Cue Frequencies would be the vehicles for increasing the level of premium service.

The next step in the creation of the premium service network is determining which Blocks to include in each Relay. The maximum number of Blocks per Relay in this embodiment is six. This is because it would be too cumbersome and time consuming for a Relay with more than six Blocks to interchange, given the mechanics of switching rail cars. Therefore, upon departure from a Node, a Relay will have a maximum of six Blocks, one each for the next six Primary and Secondary Nodes in its Route. If it is desired that one or more of the succeeding Nodes should be represented by two or more Sub-blocks, then the furthest Node(s) would lose its representation in the Relay. If more than six Primary and Secondary Nodes remain in a Route, then cars for those Nodes will have to be included in a convenient Block to an intermediate transshipment Node. If fewer than six Nodes remain, then the Relay will have fewer than six Blocks. Accordingly, the size of Blocks may increase as the Relay approaches its Route-end Node.

Figure 7:
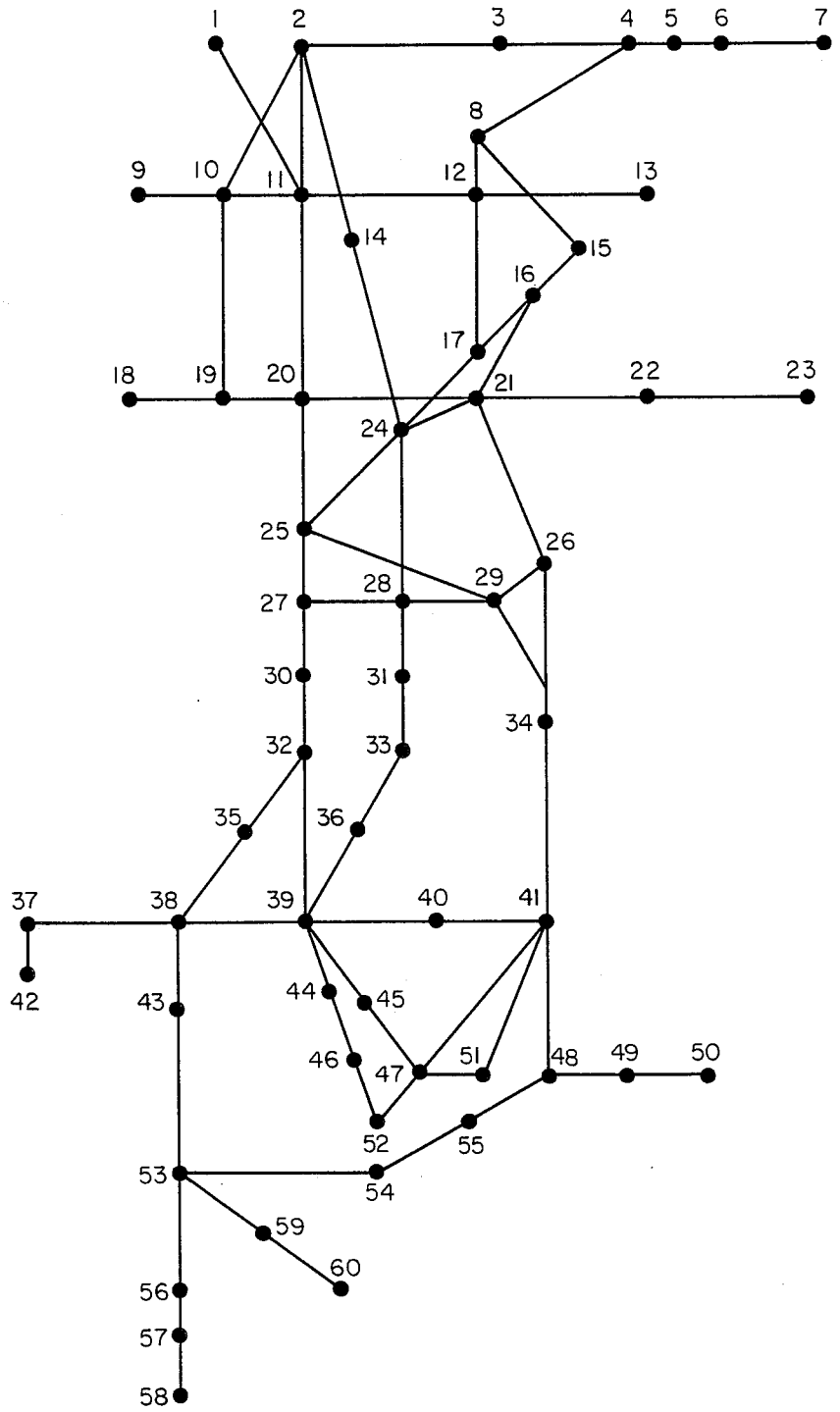
FIG. 7 shows a premium service network with Nodes and Lines.
Figure 8:
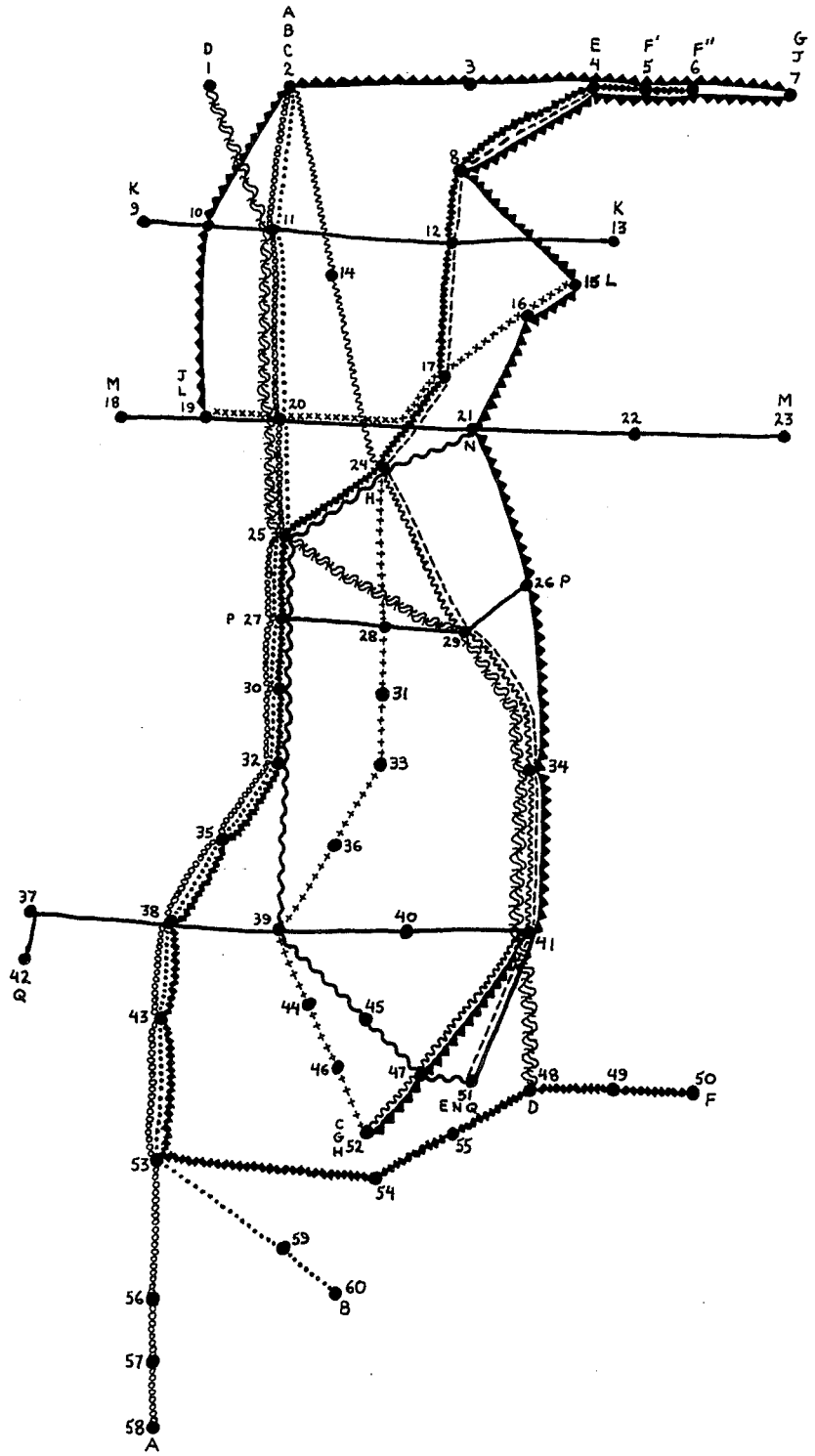
FIG. 8 shows a premium service network with Nodes and Routes letter designations of Routes shown at End-Nodes only.

FIG. 7 depicts the Nodes of this embodiment, with only the Lines shown which connect the selected premium service Nodes. FIG. 8 depicts the Nodes—labeled 1 to 60— with fifteen Routes—labeled A to H, J to N, P, and Q—delineated by separate symbols. Note that not necessarily every Node passed by a Route is included in that Route. However, in no case are Nodes on a Route more than four hours of running time apart, since crews cannot venture farther than four hours from their starting Nodes if they are to have returned in eight.

At each Primary and Secondary Node on each Route, cars are assembled once during each Cue Frequency period into a maximum of twelve Blocks of cars destined for the six successive Primary and Secondary Nodes on the same Route in each direction. If no single Route serves both the origin and destination Nodes of a car, then the car is put into a Block for logical transshipment Node intermediate to the ultimate destination. If the destination Node is farther than six Nodes away on the same Route, then the car is put in the Block for the sixth Node away or another more convenient transshipment Node, since the maximum number of Blocks in this embodiment will be six. Conventional switching techniques may be used to create the Blocks within Nodes.

The size of a Block may not exceed a predetermined length or number-of-cars limit, which is the difference between the operating capacity of the Line (given weather conditions and the locomotive horsepower available) and the forecasted sizes of other Blocks to be moved in the same Relay (train). Excess cars are held back for a succeeding Relay.

At each Primary Node at which crews are home based (as specified by Cue Sequencing), the previously assembled Blocks are themselves assembled into Relays at the start of Relay service; one Relay at each such Primary end Node and two Relays—one in each direction—at each such intermediate Primary Node on the Route. The Blocks are connected in ascending order with locomotives coupled to the Block destined for the next Node, as in FIG. 25. New Relays are assembled at end Nodes in each Cue cycle.

All cars traveling between Nodes of the premium service network move in Relays with the following possible exceptions: irregular or infrequent unit trains which cannot be split up for inclusion in Relays, or cars which are not handled in Relays due to emergencies or malfunctions in the transportation system.

Each Relay traverses the Line segment to the next Node according to a master schedule. FIGS. 9 through 23 show the fifteen Route's daily schedules, with the following information itemized: the Cue Frequency for that Route; the Nodes included in that Route listed down the center of the schedule, Primary Nodes having one prime mark (′), Secondary having double prime marks (″), and Tertiary having triple prime marks (‴); the Roman numeral designation of each daily Relay section; each Relay's arrival time at a Node, or the beginning time of Relay make-up at initial Nodes; each Relay's departure time from a Node, or the ending time of Relay break-up at final Nodes; and the designation for the crew performing each job, with each crew labeled according to its beginning Route letter followed by consecutive numbering. Crews which do work solely within one Node are not numbered but simply labeled "YD" for yard. Note that all road crews have returned to their starting Nodes after eight hours of work. It is important to note that for every Primary and Secondary Node (at which cars are interchanged) there is an hour between arrival and departure for the interchanging process.

The basic road new assignment after reporting for duty is a three-hour run to the next Node in a Relay ready to go, then interchanging that Relay's cars during the next hour, then changing to an opposing Relay which has just arrived and interchanging its cars during the next hour, and finally taking that Relay back to the crew's starting Node in a three-hour run, such as with Route J crews J1 through J18 (FIG. 17).

It is intentional that the crew's preferred workday should begin with an outbound run, build to the difficult interchange processes in the middle of the workday, and finish with a run to the home Node. It is also intentional to exploit the Relay concept in order to emphasize teamwork, time sensitivity, and regularity with crews, so that peer pressure is brought to bear to keep a Relay on time, as opposed to the unchecked and insidious incentive today for crew members to tacitly conspire to delay their trains for overtime.

The existence of the considerable interchange time allotted at each Primary and Secondary Node provides a ready vehicle for getting tardy trains back on schedule, by abridging work at a Node and thereby sacrificing scheduled transit times for a few cars in order to maintain scheduled transit times for the majority.

The basic road crew assignment must be altered for Secondary Nodes. These require shorter line-of-road runs bisected by the interchange at the Secondary Node, where the crew stays with its Relay after the interchange of cars. Route L (FIG. 19) depicts how twelve crews might service a four-hour Cue Route with three Primary and two Secondary Nodes.

There are unlimited permutations of how the eight-hour crews might be required to split up their workdays as the peculiarities of any particular network may require. For example, in Route C (FIG. 11) crews C19 through C24 have an initial four-hour run followed by an immediate change to the opposing Relay for its interchange hour.

Route F (FIG. 14) shows a case where the Route-end Node alternates between Node 5 and Node 6. These Route-end Nodes are also unusual in that they have no make-up or break-down times since their Relays are received from and delivered to other railroads (which are not part of the premium system) as run-through trains.

Sometimes crews begin with an interchange, as in Route H (FIG. 16) crews H1 through H6. Route H also demonstrates Secondary and Tertiary Nodes in succession, and crews H16 through H18 which have no interchange duty at all, only line-of-road runs.

It is recommended that schedules should be run daily with as few annulments for holidays as practicable, since each interruption of the premium service network changes the otherwise uniform door-to-door car transit times. Although it is possible for one crew to work legs of two different Routes, such as crews G7 through G12 in Routes G and J or crews G31 through G36 in Routes G and C (FIG. 15), this is not recommended since a miscue with one of these crews would affect two Routes and not just one.

Figure 24:
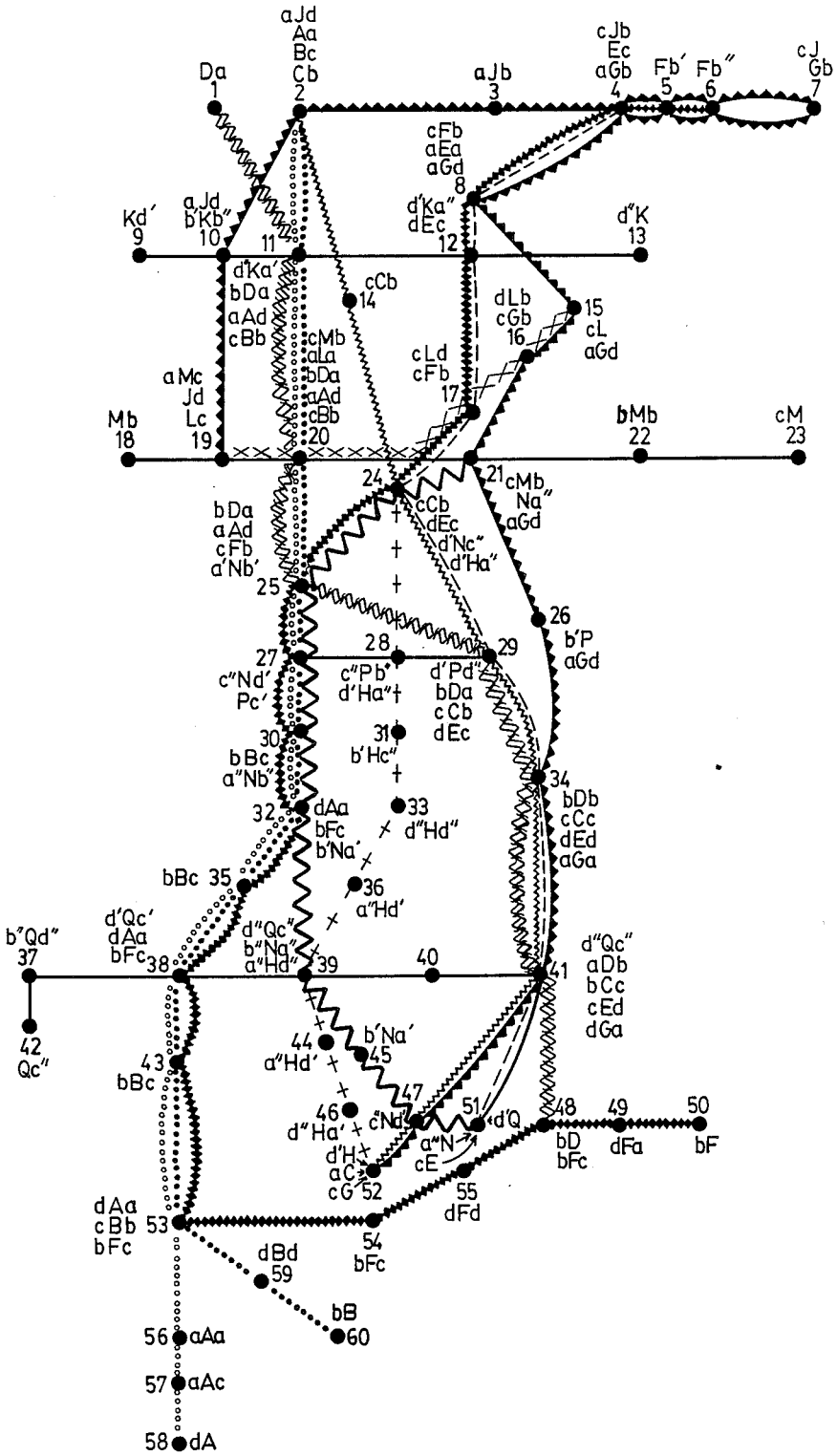
FIG. 24 shows a premium service network with Nodes, Routes, and departure sequences for Routes at Nodes where Routes are designated with Cues down-schedule to the right of the Route letter, Routes are designated with Cues up-schedule to the left of the Route letter, and Cue departure times are.

Interchange periods at any given Node should be staggered for different Routes to avoid conflicting operations, such as in Route N (FIG. 21) whose Cue is offset thirty minutes to dovetail with Route B (FIG. 8) at Node 30. FIG. 24 illustrates the sequenced departure times at all Nodes.

Upon arrival at a Primary or Secondary Node in its Route, each Relay interchanges Blocks of cars. To accomplish the manipulation of six Blocks within one hour requires that the Relay crew only handle the first three Blocks, while a yard engine and crew handle the last three plus the new Block(s) for that Node. Specifically, the Relay crew will:

(a) uncouple between old Blocks Nos. 2 and 3,
(b) drop off Block 1 (which is destined for that Node),
(c) couple the additions to Blocks Nos. 2 and 3 behind old Block 2, and
(d) recouple to old Block 3.

The yard crew will (a) couple the addition to Block 6 and new Block 7 behind old Block 6,
(b) uncouple between old Blocks Nos. 4 and 5,
(c) couple the additions to Blocks 4 and 5 in front of old Block 5, and
(d) recouple to old Block 4, thereby completing the interchange. (There is no provision or need for a caboose in this embodiment.)

FIGS. 26–32 illustrate an example of an interchange for Relay AI of route A at Node 20.

FIG. 26 depicts the configuration of sub-Blocks upon crew A7's arrival at Node 20 at 0700 according to the schedule (FIG. 9), with sub-Blocks labeled according to origin Node/destination Node. Note that there are six destination Nodes represented, thereby creating six destination Blocks.

Figure 27:
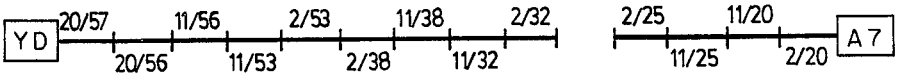

FIG. 27 depicts the crew A7 having uncoupled the Relay between Blocks for Nodes 25 and 32. A yard crew has coupled its engines and two preassembled Blocks, 20/57 and 20/56, to the rear of the Relay. Cars from Node 20 destined for Node 58, which is on Route A but farther than six Nodes away, may have been placed in Block 20/57.

Figure 28:
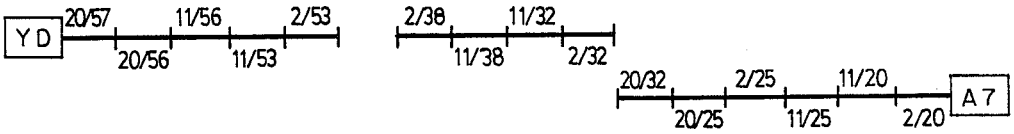

FIG. 28 depicts crew A7 having moved to another yard track and coupled its cars onto two preassembled Blocks, 20/25 and 20/32. The yard crew has uncoupled the rear of the Relay between Blocks for Nodes 53 and 38. Blocks for Nodes 38 and 32 remain stationary.

Figure 29:
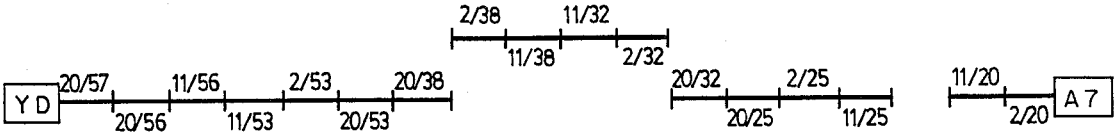

FIG. 29 depicts crew A7 having uncoupled cars for Node 20 from its other cars. The yard crew has moved to another yard track and coupled its cars onto two preassembled Blocks, 20/53 and 20/38.

Figure 30:
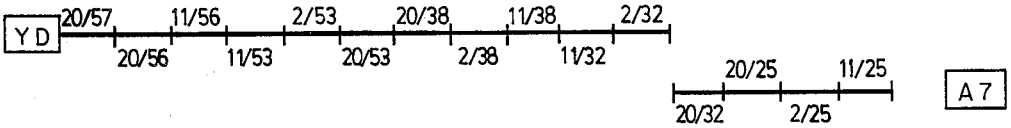

FIG. 30 depicts crew A7 having moved to another yard track and uncoupled the Block to be left behind at Node 20. Servicing or exchanging of engines would be convenient at this time. The yard crew has coupled its cars back onto stationary Blocks for Node 38.

Figure 31:
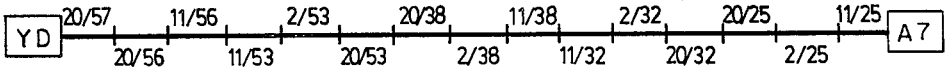

FIG. 31 depicts crew A7 having coupled its engines to Blocks 20/32, 20/25, 2/25, 11/25, and then coupled these back onto stationary Blocks for Node 32. The yard crew may have been obtaining an air brake test or other inspection procedure on the rear portion of the Relay.

Figure 32:
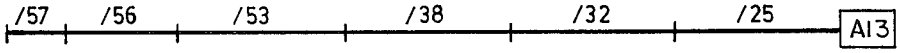

FIG. 32 depicts the finished Relay, with the yard engines uncoupled. It is ready for departure to Node 25 at 0800 (FIG. 9). Crew A7 now changes over to crew A17's former engines for return to Node 11 on Section XII. A new crew, A13, will take Section I to Node 25 at 0800.

It is desirable to arrange Blocks so that the next Block to be set off is placed next to the engines as described above. In case the Relay falls behind schedule, this allows that Block to be set off by the engines without handling other cars in the train, thereby quickly accomplishing the more important set-off portion and allowing abridgement of the pick-up portion of the interchange. Also, in case an emergency set-off of a car at a customer's private siding must be made, the car will always be near the engines in the first Block back, making the set-out procedure more manageable.

Relays proceed on their assigned schedules, with crews changing directions each four hours and with car interchanging at Primary and Secondary Nodes. Information concerning the composition of the Blocks in oncoming Relays is transmitted ahead so that maximum Relay length is never exceeded. The four-hour interchanging Relay is the building block of this embodiment.

Upon arrival at its destination Route-end Node, each Relay will be composed solely of a Block whose destination or transshipment destination is that Node. The Relay Section therefore terminates, and its engines are released for other Cue Frequencies could be eight hours or any division of eight by a power of two (8, 4, 2, 1, ½, etc.), but are preferred to be either 8 or 4 hours to limit crews to one reversal of direction per shift. Routes, Cue Frequencies, Cue Sequencing, and schedules should be adjusted to accommodate traffic flows, such that:

(a) the forecasted accretion of cars at a Node both from local and transshipment sources does not exceed the Block-size limits of the next Relay going in the desired direction, or is within an acceptable probability of exceeding the Block-size limits;

(b) opposing Relays can meet at places on the Line segments or Nodes where they can pass each other without undue delay;

(c) Relays are not scheduled to travel in the same direction over a Line segment in such close proximity that small deviations from their schedules cause interference; and (d) Relays on different Routes are scheduled to arrive at and depart from Nodes such that track space, yard engines, and yard crews are all conserved and kept productive, as practicable.

The continuous and frequent service available at each Node with the four-hour interchanging Relays lends itself to tight inventory control of equipment. A fast assimilation and turn-around of cars at Nodes translates into less yard track required for holding cars until the next departure and fewer cars required. The four-hour interchanging Relays make greatly accelerated classification possible because of the ability to schedule classification times for arriving Blocks evenly and with great certainty, and because of smaller Block sizes. It will become possible to classify cars arriving on Relays into their subsequent Blocks for local delivery or transshipment on another Relay within one hour, as opposed to the four-to-eight hours possible with current operating procedures.

The continuous and frequent service from four-hour interchanging Relays is also extremely powerful in reducing absolute transit time and the standard deviation of transit time. To illustrate using FIG. 8, consider a merchandise freight car to be moved from Node 18 to Node 55. It would take 80 average hours transit time using conventional blocks run each twenty-four hours, versus 50 average hours using four-hour interchanging Relays (FIG. 33). Much more commercially important than absolute transit time reductions however is increased dependability, since the back-up service for missed connections would be a reliable four hours away instead of an unreliable twenty-four.

Sensitivity analysis on changes in the four-hour interchanging Relays could be easily conducted. Aggregated system wide transit times could be calculated for different Nodes, Blocks, Relays, and schedules using a simple electronic spreadsheet. It would also be sharply apparent whether there were excess capacity in a Relay system, or whether additional traffic caused additional Relays to be required.

When the operation of the four-hour interchanging Relays pauses or stops, it is advisable to stop all Relays on each Route after the same Cue cycle, since scrolling Relays into limited Nodes would overtax the track capacity and engine-servicing facilities of those Nodes.

It will be apparent to the student of railroad operations that the foregoing embodiment of the present invention could not be effected without changes in certain regulations, labor agreements, and physical plant configurations. Although some of the necessary changes are substantial, such as a change to the 500 mile brake test rule and the elimination of distinctions between yard and line-of-road crew assignments, the changes are all feasible. Yet by themselves the changes in rules, regulations, and tracks would not accomplish the desired service an working condition improvements. The improvements are a direct result of the four-hour interchanging Relays of the present invention, and they include:

(a) normalization and simplification of system wide train movements so that start-to-finish transit times for cars can be easily calculated;

(b) many fold increase in service frequency between any two given points, resulting in better overall transit times and in sharply reduced time penalties if connections are missed;

(c) the ability to guarantee standard service;

(d) the ability to provide road crews with regular eight-hour workdays ending at their home terminals;

(e) the ability to eliminate wasted crew time due to conflicting movements or short crew districts;

(f) improvements in the interdependent utilization of track and engine assets through the spread timing of yard classification and line-of-road occupancy, versus the current uncontrollable bunched requirements;

(g) compatibility with existing railroad plant structures and technology, requiring comparatively small capital improvements in selected yard classification tracks and passing sidings;

(h) the collateral benefits of the informational discipline imposed on the system, including easier costing, better control over the stochastic process of providing empty equipment, and quicker reactions to market conditions; and (i) the collateral benefits of providing a Relay mentality among crews to foster internal competition to stay on schedule.

I claim:

1. An improved method of operating a freight train system on a predefined network of rail lines wherein freight trains comprise locomotive means, freight cars and operating method comprising:

(a) establishing an array of Nodes throughout said linear network whereat trains arrive and/or depart, defining:

(i) Primary Nodes as Nodes whereat both operating crews and freight cars are interchanged;

(ii) Secondary Nodes as Nodes whereat freight cars are interchanged and operating crews are not; and (iii) Tertiary Nodes as Nodes whereat operating crews are interchanged and freight cars are not;

(b) defining a plurality of Routes for the freight trains such that:

(i) each Route includes a set of Nodes along a linear path within said network, (ii) each said set of Nodes comprises at least Nodes at each end of said linear path which are defined as Primary Nodes, and (iii) all Nodes are included in at least one Route;

(c) selectively configuring trains into Relays for departure from each Primary and Secondary Node including:

(i) grouping freight cars destined for common destination Nodes together in contiguous linear Blocks; and (ii) selectively determining a maximum number of said Blocks for each Relay such that each Relay departing from a given Node along its given Route comprises only Blocks destined for the maximum Block number of next consecutive Primary and Secondary Nodes whereby freight cars to be delivered to more distant Primary and Secondary Nodes along said Route are transshipped through an intermediate Primary or Secondary Node destination;

(d) selecting a maximum Cue Frequency being the upper limit of selected Cue Frequencies for each Route, Cue Frequency being a uniform time interval between successive Relays on said Routes;

(e) for each said Route, operating at least a number of Relays equal to the number of Primary and Tertiary Nodes contained within the respective Route minus one $(P+T-1)$ such that Relays depart in each direction:

(i) from at least every other Primary and Tertiary Node at the commencement of operation, and (ii) from every Node exactly once during each Cue Frequency interval thereafter during operation; and (f) scheduling crews to operate said Relays upon their respective Routes such that crews are scheduled to return to their Node of origin within the maximum Cue Frequency.

2. An improved method of operating a freight train system according to claim 1 wherein said maximum Cue Frequency equals a desired shift length for operating crews.

3. An improved method of operating a freight train system according to claim 1 wherein said selectively configuring trains for departure from each Primary and Secondary Node further includes sequentially ordering said Blocks corresponding to the order of Nodes along the linear path of the Route on which the Relay is operating.

4. An improved method of operating a freight train system according to claim 3 further comprising:

selectively disassembling each Relay upon arrival at a Primary or Secondary Node including:

(a) removing the Block of the Relay destined for that Node;

(b) separating alternate Blocks remaining in the Relay for the insertion of two Sub-blocks at each separation whereby said selected configuring of said Relay for departure is facilitated.

5. An improved method of operating a freight train system according to claim 3 wherein Blocks of freight cars are connected to the locomotive means for each Relay such that the Block destined for the next Primary or Secondary Node along the Relay's Route is adjacent said locomotive means.

6. An improved method of operating a freight train system according to claim 1 wherein for at least one Route the number of Relays is equal to twice the number of Primary and Tertiary Nodes contained within the respective Route minus one $(2(P+T-1))$ such that Relays depart in each direction from each Primary and Tertiary Node at the commencement of operation and at every Cue Frequency interval thereafter during operation.

7. An improved method of operating a freight train system according to claim 1 wherein all Nodes ar Primary Nodes.

8. An improved method of operating a freight train system according to claim 1 wherein all Nodes are Primary or Secondary Nodes.

9. An improved method of operating a freight train system according to claim 1 wherein all Nodes are Primary or Tertiary Nodes.

10. An improved method of operating a freight train system according to claim 1 wherein each Route includes selected intermediate Nodes along its said linear path.

11. An improved freight train system comprising:

(a) a predefined network of rail lines upon which a plurality of freight trains operate;

(b) each said freight train including locomotive means, freight cars and an operating crew;

(c) an array of Nodes established throughout said linear network whereat trains arrive and/or depart, said Nodes defined as:

(i) Primary Nodes whereat both operating crews and freight cars are interchanged;

(ii) Secondary Nodes whereat freight cars are interchanged and operating crews are not; or (iii) Tertiary Nodes whereat operating crews are interchanged and freight cars are not;

(d) a plurality of Routes for said freight trains, said Routes being configured such that:

(i) each Route includes a set Nodes along a linear path within said network, (ii) each said set of Nodes comprises at least Nodes at each end of said linear path which are thereby defined as Primary Nodes, and (iii) all Nodes are included in at least one Route;

(e) said trains being selectively configured into Relays for departure from each Primary and Secondary Node such that:

(i) freight cars destined for common destination Nodes are grouped together in contiguous linear Blocks; and (ii) each Relay comprises no more than a selected maximum number of said Blocks such that each Relay departing from a given Node along its given Route comprises only Blocks destined for the maximum Block number of next consecutive Primary and Secondary Nodes whereby freight cars to be delivered at more distant Primary and Secondary Nodes along said Route are transshipped to an intermediate Primary or Secondary Node destination;

(f) the frequency of successive Relays for said Routes being scheduled with respect to a selected uniform time interval defined as the Cue Frequency;

(g) at least a number of Relays equal to the number of Primary and Tertiary Nodes contained within the respective Route minus one (P+T−1) being operated upon each said Route such that Relays depart in each direction:

(i) from at least every other Primary and Tertiary Node at the commencement of operation, and (ii) from every during each Cue Frequency interval thereafter during operation; and (h) crews being scheduled to operate said Relays upon their respective Routes such that crews are scheduled to return to their respective Nodes of origin within the maximum Cue Frequency.

12. An improved freight train system according to claim 11 wherein said selected maximum Cue Frequency equals a desired shift length for operating crews.

13. An improved freight train system according to claim 11 wherein said Relays are selectively configured for departure from each Primary and Secondary Node such that said Blocks are sequentially ordered corresponding to the order of Nodes along the linear path of the Route on which the Relay is operating.

14. An improved freight train system according to claim 13 further comprising:

each Relay being selectively disassembled upon arrival at a Primary or Secondary Node including:

(a) the Block of the Relay destined for that Node being removed;

(b) alternate Blocks remaining in the Relay being separated for the insertion of two Sub-blocks at each separation whereby said selected configuring of said Relay for departure is facilitated.

15. An improved freight train system according to claim 13 wherein Blocks of freight cars are connected to the locomotive mean for each Relay such that the Block destined for the next Primary or Secondary Node along the Relay's Route is adjacent said locomotive means.

16. An improved freight train system according to claim 11 wherein for at least one Route, the number of Relays is equal to twice the number of Primary and Tertiary Nodes contained within the respective Route minus one (2(P+T−1)) such that Relays depart in each direction from each Primary and Tertiary Node at the commencement of operation and at every Cue Frequency interval thereafter during operation.

17. An improved freight train system according to claim 11 wherein all Nodes are Primary Nodes.

18. An improved freight train system according to claim 11 wherein all Nodes are Primary or Secondary Nodes.

19. An improved freight train system according to claim 11 wherein all Nodes are Primary or Tertiary Nodes.

20. An improved freight train system according to claim 11 wherein each Route includes selected intermediate Nodes along its said linear path.

21. An improved method of operating a transportation system on a predefined linear network wherein units are transported in Relays which comprise motive means, Units and operating means, the method comprising:

(a) establishing an array of Nodes throughout said linear network whereat Relays arrive and/or depart defining:

(i) Primary Nodes as Nodes whereat both operating means and Units are interchanged;

(ii) Secondary Nodes as Nodes whereat Units are interchanged and operating means are not; and (iii) Tertiary Nodes as Nodes whereat operating means are interchanged and Units are not;

(b) defining a plurality of Routes for the Relays (i) each Route includes a set of Nodes along a linear path within said network, (ii) each said set of Nodes comprises at least Nodes at each end of said linear path which are defined as Primary Nodes, and (iii) all Nodes are included in at least one Route;

(c) selectively configuring Relays for departure from each Primary and Secondary Node including:

(i) grouping Units destined for common destination Nodes together in contiguous linear Blocks; and (ii) selectively determining a maximum number of said Blocks for each Relay such that each Relay departing from a given Node along its given Route comprises only Blocks destined for the maximum Block number of next consecutive Primary and Secondary Nodes whereby Units to be delivered at more distant Primary and Secondary Nodes along said Route are transshipped to an intermediate Primary or Secondary Node destination;

(d) selecting a maximum Cue Frequency being the upper limit of selected Cue Frequencies for each Route, Cue Frequency being a uniform time interval between successive Relays on said Routes;

(e) for each said Route, operating at least a number of Relays equal to the number of Primary and Tertiary Nodes contained within the respective Route minus one (P+T−1) such that Relays depart in each direction:

(i) from at least every other Primary and Tertiary Node at the commencement of operation, and (ii) from every Node exactly once during each Cue Frequency interval thereafter during operation; and (f) scheduling the operating means to operate said Relays upon their respective Routes such that operating means are scheduled to return to their respective Nodes of origin within the maximum Cue Frequency.

22. An improved transportation system comprising:

(a) a predefined linear network wherein Units are transported in Relays;

(b) said Relays including motive means, Units and operating means;

(c) an array of Nodes established throughout said linear network whereat Relays arrive and/or depart, said Nodes defined as (i) Primary Nodes whereat both operating means and Units are interchanged;

(ii) Secondary Nodes whereat Units are interchanged and operating means are not; or (iii) Tertiary Nodes whereat operating means are interchanged and Units are not;

(d) a plurality of Routes for said Relays, said Routes configured such that:

(i) each Route includes a set Nodes along a linear path within said network, (ii) each said set of Nodes comprises at least Nodes at each end of said linear path which are thereby defined as Primary Nodes, and (iii) all Nodes are included in at least one Route;

(e) said Relays being selectively configured for departure from each Primary and Secondary Node such that:

(i) Units destined for common destination Nodes are grouped together in contiguous linear Blocks; and (ii) each Relay comprises no more than a selected maximum number of said Blocks such that each Relay departing from a given Node along its given Route comprises only Blocks destined for the maximum Block number of next consecutive Primary and Secondary Nodes whereby Units to be delivered at more distant Primary and Secondary Nodes along said Route are transshipped to an intermediate Primary or Secondary Node destination;

(f) the frequency of successive Relays for said Routes being scheduled with respect to a selected uniform time interval defined as the Cue Frequency;

(g) at least a number of Relays equal to the number of Primary and Tertiary Nodes contained within the respective Route minus one $(P+T-1)$ being operated upon each said Route such that Relays depart in each direction:

(i) from at least every other Primary and Tertiary Node at the commencement of operation, and (ii) from every Node once during each Cue Frequency interval thereafter during operation; and (h) operating means being scheduled to operate said Relays upon their respective Routes such that operating means are scheduled to return to their respective Nodes of origin within a selected maximum Cue Frequency.

* * * * *